US012139794B2

(12) United States Patent
Sandhage

(10) Patent No.: US 12,139,794 B2
(45) Date of Patent: Nov. 12, 2024

(54) METHOD OF ENHANCING CORROSION RESISTANCE OF OXIDIZABLE MATERIALS AND COMPONENTS MADE THEREFROM

(71) Applicant: Purdue Research Foundation, West Lafayette, IN (US)

(72) Inventor: Kenneth H. Sandhage, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 189 days.

(21) Appl. No.: 16/342,597

(22) PCT Filed: Oct. 11, 2017

(86) PCT No.: PCT/US2017/056015
§ 371 (c)(1),
(2) Date: Apr. 17, 2019

(87) PCT Pub. No.: WO2018/075299
PCT Pub. Date: Apr. 26, 2018

(65) Prior Publication Data

US 2019/0256979 A1 Aug. 22, 2019

Related U.S. Application Data

(60) Provisional application No. 62/409,618, filed on Oct. 18, 2016.

(51) Int. Cl.
*C23C 18/16* (2006.01)
*C23C 18/18* (2006.01)
(Continued)

(52) U.S. Cl.
CPC ..... *C23C 18/1685* (2013.01); *C23C 18/16* (2013.01); *C23C 18/1603* (2013.01);
(Continued)

(58) Field of Classification Search
CPC ... C23C 30/00; C23C 30/005; C23C 18/1685; C23C 18/31; C23C 18/16;
(Continued)

(56) References Cited

U.S. PATENT DOCUMENTS

2004/0071873 A1* 4/2004 DeYoung ..... H01L 21/32134 427/248.1
2010/0247291 A1* 9/2010 Tholen ..... C23C 26/00 415/116
2013/0255248 A1* 10/2013 Dimascio ..... F03G 7/06 60/527

FOREIGN PATENT DOCUMENTS

WO WO 2015/016931 * 2/2015

OTHER PUBLICATIONS

Firouzdor, V., et al., "Corrosion of a stainless steel and nickel-based alloys in high temperature supercritical carbon dioxide environment," Corrosion Science, 2013, vol. 69, pp. 281-291. (Year: 2013).*

(Continued)

*Primary Examiner* — Michael E. La Villa
(74) *Attorney, Agent, or Firm* — Hartman Global IP Law; Gary M. Hartman; Domenica N. S. Hartman

(57) ABSTRACT

Methods of enhancing the corrosion resistance of an oxidizable material exposed to a supercritical fluid is disclosed One method includes placing a surface layer on an oxidizable material, and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

24 Claims, 5 Drawing Sheets

(51) Int. Cl.

| | |
|---|---|
| ***C23C 18/31*** | (2006.01) |
| ***C23C 18/32*** | (2006.01) |
| ***C23C 18/38*** | (2006.01) |
| ***C23C 18/48*** | (2006.01) |
| ***C23C 30/00*** | (2006.01) |

(52) U.S. Cl.
CPC ..... *C23C 18/1635* (2013.01); *C23C 18/1637* (2013.01); *C23C 18/1646* (2013.01); *C23C 18/18* (2013.01); *C23C 18/1803* (2013.01); *C23C 18/31* (2013.01); *C23C 18/32* (2013.01); *C23C 18/38* (2013.01); *C23C 18/48* (2013.01); *C23C 30/00* (2013.01); *C23C 30/005* (2013.01); *Y10T 428/1259* (2015.01); *Y10T 428/12611* (2015.01); *Y10T 428/12618* (2015.01); *Y10T 428/1266* (2015.01); *Y10T 428/12667* (2015.01); *Y10T 428/12806* (2015.01); *Y10T 428/12812* (2015.01); *Y10T 428/12819* (2015.01); *Y10T 428/12826* (2015.01); *Y10T 428/12833* (2015.01); *Y10T 428/1284* (2015.01); *Y10T 428/12847* (2015.01); *Y10T 428/12854* (2015.01); *Y10T 428/12861* (2015.01); *Y10T 428/12882* (2015.01); *Y10T 428/12903* (2015.01); *Y10T 428/1291* (2015.01); *Y10T 428/12917* (2015.01); *Y10T 428/12924* (2015.01); *Y10T 428/12931* (2015.01); *Y10T 428/12937* (2015.01); *Y10T 428/12944* (2015.01); *Y10T 428/12951* (2015.01); *Y10T 428/12972* (2015.01); *Y10T 428/12986* (2015.01)

(58) Field of Classification Search
CPC ..... C23C 18/1603; C23C 18/1635; C23C 18/1637; C23C 18/1646; C23C 18/18; C23C 18/1803; C23C 18/32; C23C 18/38; C23C 18/48; Y10T 428/1266; Y10T 428/12667; Y10T 428/1259; Y10T 428/12611; Y10T 428/12618; Y10T 428/12847; Y10T 428/1291; Y10T 428/12917; Y10T 428/12924; Y10T 428/12931; Y10T 428/12937; Y10T 428/12944; Y10T 428/12951; Y10T 428/12972; Y10T 428/12986; Y10T 428/12806; Y10T 428/12812; Y10T 428/12819; Y10T 428/12826; Y10T 428/12833; Y10T 428/1284; Y10T 428/12854; Y10T 428/12861; Y10T 428/12882; Y10T 428/12903
See application file for complete search history.

(56) References Cited

OTHER PUBLICATIONS

Biofuel.Org, "What is Syngas," downloaded from www.biofuel.org.uk on Dec. 27, 2022 (two pages)(2010, no month). (Year: 2010).*

* cited by examiner

METHOD OF ENHANCING CORROSION RESISTANCE OF OXIDIZABLE MATERIALS AND COMPONENTS MADE THEREFROM

CROSS-REFERENCE TO RELATED APPLICATIONS

The present U.S. patent application is a 35 U.S.C. § 371 national phase application of PCT/US2017/056015, filed Oct. 11, 2017, which is related to and claims the priority benefit of U.S. Provisional Patent Application Ser. No. 62/409,618, filed Oct. 18, 2016. The contents of both these applications are hereby incorporated by reference in their entirety into the present application.

STATEMENT REGARDING GOVERNMENT FUNDING

This invention was made with government support under Contract No. DE-EE0007117 awarded by the U.S. Department of Energy, Office of Energy Efficiency and Renewable Energy. The government has certain rights in the invention.

TECHNICAL FIELD

This disclosure generally relates to methods for achieving the corrosion resistance of metals, metallic alloys, ceramics, and ceramic composites in high-temperature, high-pressure, corrosive fluid environments, especially where the fluid includes a supercritical fluid.

BACKGROUND

This section introduces aspects that may help facilitate a better understanding of the disclosure. Accordingly, these statements are to be read in this light and are not to be understood as admissions about what is or is not prior art.

Carbon dioxide, $CO_2$, possesses critical temperature and pressure values of 31° C. and 7.4 MPa, respectively. At higher temperatures and pressures, $CO_2$ becomes "supercritical", and possesses a density more like that of a liquid than a gas, while also possessing a fluidity more like that of a gas than a liquid. Supercritical $CO_2$ is also a relatively low-cost, readily-available, stable, non-toxic, and non-flammable fluid. These characteristics make supercritical $CO_2$ a highly-attractive working fluid for applications including, but not limited to, closed-loop power generation. For example, by switching to the use of supercritical $CO_2$, traditional power generation systems utilizing steam Brayton or Rankine cycles can exhibit significantly increased efficiency and power generation. The non-flammability and thermal stability of supercritical $CO_2$ allows for the direct exchange of heat from a high-temperature source (e.g., a high-temperature gas, liquid, supercritical fluid, solid, or plasma) to supercritical $CO_2$, which then means that the resulting heated, high-temperature supercritical $CO_2$ can be used as a relatively high-temperature working fluid in an efficient power cycle (e.g., to spin a turbine at a relatively high temperature to generate electricity in a relatively efficient manner). The low values of critical temperature and critical pressure of $CO_2$ relative to those for $H_2O$ (i.e., 31° C. and 7.4 MPa for $CO_2$ vs. 374° C. and 22.1 MPa for $H_2O$) can also eliminate the need for heat input for a phase change as is common for water to steam conversion. Furthermore, the relatively high density of supercritical $CO_2$ allows for the use of significantly more compact yet efficient turbomachinery including, but not limited to, compact turbines and compact heat exchangers (such as microchannel heat exchangers). The compact nature of turbomachinery enabled by operation with supercritical $CO_2$ also reduces the capital costs, operating costs, and footprint of such turbomachinery.

Supercritical $CO_2$ is an oxidizing fluid, owing to the oxygen-rich nature of this fluid. Consequently, the exposure of oxidizable materials (oxidizable metals, oxidizable metallic alloys, oxidizable ceramics, or ceramic composites containing one or more oxidizable phases) to supercritical $CO_2$ at elevated temperatures (i.e., at high temperatures where the benefits of enhanced efficiency of turbomachinery and power systems can be achieved using supercritical $CO_2$) can result in the oxidative corrosion and degradation of such materials.

Supercritical $H_2O$ is also an oxidizing fluid, owing to the oxygen-rich nature of this fluid. Consequently, the exposure of oxidizable materials (oxidizable metals, oxidizable metallic alloys, oxidizable ceramics, ceramic composites containing one or more oxidizable phases) to supercritical $H_2O$ at elevated temperatures (i.e., at high temperatures where the benefits of enhanced efficiency of turbomachinery and power systems can be achieved using supercritical $H_2O$) can result in the oxidative corrosion and degradation of such materials.

Accordingly, there is a desire for methods for achieving a high degree of corrosion resistance of metals, metallic alloys, ceramics, and ceramic composites in high-temperature, high-pressure, corrosive fluid environments, where the fluid includes, but is not limited to, a gas, a liquid, or a supercritical fluid or a mixture containing two or more of a gas, a liquid, and a supercritical fluid. There is also a desire for such corrosion-resistant metals, metallic alloys, ceramics, and ceramic composites, and operational conditions leading to such corrosion-resistant metals, metallic alloys, ceramics, and ceramic composites, for use in high-temperature, high-pressure, corrosive fluid environments, where the fluid includes, but is not limited to, a gas, a liquid, or a supercritical fluid or a mixture containing two or more of a gas, a liquid, and a supercritical fluid.

SUMMARY

A method of enhancing the corrosion resistance of an oxidizable material exposed to a supercritical fluid is disclosed. The method includes placing a surface layer on an oxidizable material, and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

A corrosion-resistant component is disclosed. The corrosion-resistant component is prepared by a method which includes placing a surface layer on an oxidizable material; and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

A high temperature system is disclosed. The high-temperature system includes a corrosion-resistant component prepared by a method which includes comprising: placing a surface layer on an oxidizable material; and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

A method of enhancing the corrosion resistance of an oxidizable material exposed to a supercritical fluid is disclosed The method includes choosing a buffered supercritical fluid containing a reducing agent with the composition of the buffered supercritical fluid containing the reducing agent chosen to avoid the corrosion of the oxidizable material or reduce the rate of corrosion of the oxidizable material at a temperature above the supercritical temperature and supercritical pressure of the supercritical fluid.

Another corrosion-resistant components disclosed. This corrosion-resistant component is prepared by a method which includes choosing a buffered supercritical fluid containing a reducing agent with the composition of the buffered supercritical fluid containing the reducing agent chosen to avoid the corrosion of the oxidizable material or reduce the rate of corrosion of the oxidizable material at a temperature above the supercritical temperature and supercritical pressure of the supercritical fluid.

Another high temperature system is disclosed. This high-temperature system includes a corrosion-resistant component prepared by a method comprising choosing a buffered supercritical fluid containing a reducing agent with the composition of the buffered supercritical fluid containing the reducing agent chosen to avoid the corrosion of the oxidizable material or reduce the rate of corrosion of the oxidizable material at a temperature above the supercritical temperature and supercritical pressure of the supercritical fluid.

It is to be recognized that many variations of the materials described in the above methods and systems of this disclosure are possible and are considered to be part of this disclosure.

BRIEF DESCRIPTION OF DRAWINGS

FIGS. 4C, 4D, 4E, and 4F were obtained at the same location on the specimen cross-section as the backscattered electron image shown in FIG. 4B.

DETAILED DESCRIPTION

Figure 1:
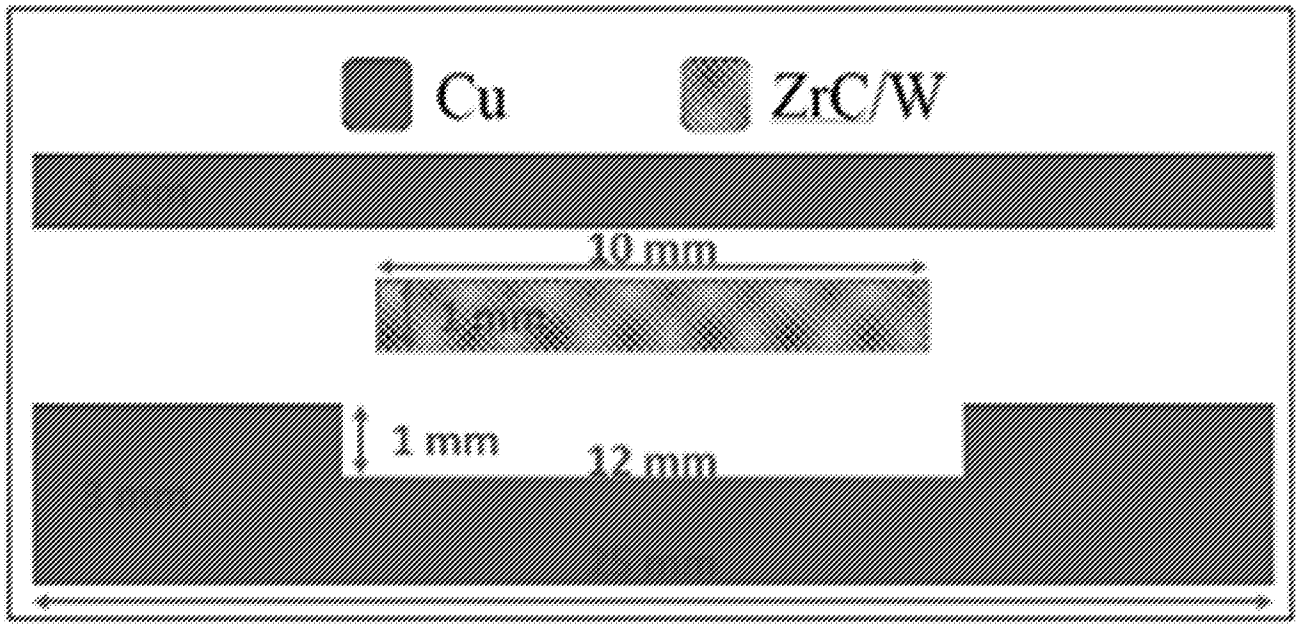
FIG. 1 shows a schematic illustration of a ZrC/W plate (1 cm×1 cm×1 mm), a Cu foil (1 mm thick) and a Cu plate (12 mm×12 mm×3 mm) containing a square cavity (note: this illustration shows the individual ZrC/W plate, Cu foil, and Cu plate prior to diffusion bonding). After placing the ZrC/W plate into the square cavity in the Cu plate, the Cu foil was placed on top of the ZrC/W plate and the Cu plate, and the assembly was diffusion bonded together (the diffusion bonded assembly is not shown in this schematic illustration).

For the purposes of promoting an understanding of the principles of the disclosure, reference will now be made to the embodiments described in this description and specific language will be used to describe the same. It will nevertheless be understood that no limitation of the scope of the disclosure is thereby intended, such alterations and further modifications in the illustrated embodiments, and such further applications of the principles of the disclosure as described therein being contemplated as would normally occur to one skilled in the art to which the disclosure relates.

The present invention generally provides methods for achieving the corrosion resistance of metals, metallic alloys, ceramics, and ceramic composites in high-temperature, high-pressure, corrosive fluid environments, where the fluid includes, but is not limited to, a gas, a liquid, or a supercritical fluid or a mixture containing two or more of a gas, a liquid, and a supercritical fluid. The present invention particularly relates to methods for achieving the corrosion resistance of mechanically-robust metals, metallic alloys, ceramics, and ceramic composites in high-temperature, high-pressure fluid environments. The present invention particularly relates to methods for achieving the corrosion resistance of thermally-conductive metals, metallic alloys, ceramics, and ceramic composites in high-temperature, high-pressure fluid environments. The present invention particularly relates to methods for achieving the corrosion resistance of electrically-conductive metals, metallic alloys, ceramics, and ceramic composites in high-temperature, high-pressure fluid environments.

The present invention further relates to solid materials (including, but not limited to, metals, metallic alloys, ceramics, and ceramic composites) and fluid materials (including, but not limited to, buffered supercritical gas mixtures (such as supercritical mixtures of CO and $CO_2$ or supercritical mixtures of $H_2$ and $H_2O$) used to achieve the corrosion resistance of metals, metallic alloys, ceramics, and ceramic composites in high-temperature, high-pressure, corrosive fluid environments, where the fluid includes, but is not limited to, a gas, a liquid, or a supercritical fluid or a mixture containing two or more of a gas, a liquid, and a supercritical fluid. The terms supercritical fluid, supercritical temperature and supercritical pressure, as used in this disclosure are well understood by persons of ordinary skill in the art. In addition, the following definition (taken from C. H. P. Lupis, Chemical Thermodynamics of Materials, 1983, Elsevier Science Publishers, New York, NY) is also helpful: "A supercritical fluid is a fluid at a temperature and pressure above its critical point. Above the critical point, distinct liquid and gas phases do not exist. At the critical point, the derivative of the pressure with volume at a fixed temperature is zero, and the second derivative of the pressure with volume at a fixed temperature is zero. That is: $\partial P/\partial V|_T=0$ and $\partial^2 P/\partial V^2|_T=0$". A buffered supercritical gas mixture refers to a supercritical gas mixture that is tailored to fix the oxygen fugacity at a particular value at a given temperature and total pressure. Such a buffered supercritical gas mixture includes, but is not limited to, a supercritical mixture of CO and $CO_2$ with a fixed ratio of CO to $CO_2$ at a given temperature and pressure. By fixing the $CO/CO_2$ ratio at a given temperature and total pressure, the oxygen fugacity is fixed to a particular value, which may include a low value as discussed below. Such a buffered supercritical gas mixture includes, but is not limited to, a supercritical mixture of $H_2$ and $H_2O$ with a fixed ratio of $H_2$ to $H_2O$ at a given temperature and pressure. By fixing the $H_2/H_2O$ ratio at a given temperature and total pressure, the oxygen fugacity is fixed to a particular value, which may include a low value as discussed below. The present invention particularly relates to mechanically-robust solid materials (including, but not limited to, metals, metallic alloys, ceramics, and ceramic composites) and fluid materials (including, but not limited to, buffered supercritical gas mixtures, such supercritical mixtures of CO and $CO_2$ or supercritical mixtures of $H_2$ and $H_2O$) used to achieve the corrosion resistance of metals, metallic alloys, ceramics, and ceramic composites in high-temperature, high-pressure, corrosive fluid environments. The present invention particularly relates to thermally-conductive solid materials (including, but not limited to, metals, metallic alloys, ceramics, and ceramic composites) and fluid materials (including, but not limited to, supercritical buffer gas mixtures, such supercritical mixtures of CO and $CO_2$ or supercritical mixtures of $H_2$ and $H_2O$) used to achieve corrosion resistance of metals, metallic alloys, ceramics, and ceramic composites in high-temperature, high-pressure, corrosive fluid environments. The present invention particularly relates to electrically-conductive solid materials (including, but not limited to, metals, metallic alloys, ceramics, and ceramic composites) and fluid materials (including, but not limited to, buffered supercritical gas mixtures, such supercritical mixtures of CO and $CO_2$ or supercritical mixtures of $H_2$ and $H_2O$) used to achieve the corrosion resistance of metals, metallic alloys, ceramics, and ceramic composites in high-temperature, high-pressure, corrosive fluid environments.

The present invention also relates to components and devices comprised of corrosion-resistant metals, metallic alloys, ceramics, and ceramic composites for use in high-temperature, high-pressure, corrosive fluid environments, where the fluid includes, but is not limited to, a gas, a liquid, or a supercritical fluid or a mixture containing two or more of a gas, a liquid, and a supercritical fluid.

The present invention generally provides methods for achieving the corrosion resistance of metals, metallic alloys, ceramics, and ceramic composites in high-temperature, high-pressure, corrosive fluid environments for use in components in high-temperature, high-pressure systems. Such high-temperature, high-pressure systems include, but are not limited to, systems for transportation, energy (e.g., electrical power) production, energy storage, waste heat recovery, propulsion, national defense, chemical processing, and chemical and waste storage. Notable transportation systems include, but are not limited to, systems for automobiles, trucks, trains, aircraft, spacecraft, ships, and submarines. Notable electrical power production systems include, but are not limited to, systems for fossil fuel-derived power, solar energy-derived power, nuclear energy-derived power, and thermionics. Notable solar energy-derived power production systems include concentrating solar power production systems. Notable energy storage systems include, but are not limited to, systems for the storage of solids, liquids, gases, or plasmas. Notable propulsion systems include, but are not limited to, systems for chemical fuel-based propulsion, nuclear fuel-based propulsion, and ion propulsion. Notable national defense systems include, but are not limited to, systems for hypersonic aircraft and hypersonic missiles. Notable components suitable for use in such high temperature, high-pressure systems include, but are not limited to, heat exchangers, piping, valves, storage containers for high-temperature solids and fluids, pumps, bearings, heat sinks, liquid metal handling equipment, engine components (such as turbine blades, pistons, compressors, combustion chambers), and energy conversion devices. Such high-temperature, high-pressure, corrosive fluid environments include, but are not limited to, environments comprised of high-temperature, high-pressure, corrosive gases, liquids, supercritical fluids, or mixtures containing two or more of a gas, a liquid, or a supercritical fluid.

An oxidizing fluid may be rendered non-oxidizing or inert to a given material by mixing such a fluid with another reducing species so as to yield a buffered fluid mixture with a low and controllable fugacity of the oxidizing species. Consider, for example, the case of supercritical $CO_2$. The addition of CO to supercritical $CO_2$ yields a buffered fluid with an equilibrium oxygen ($O_2$) fugacity established by the following reaction:

$$2CO+O_2=2CO_2 \quad (1)$$

By controlling the relative amounts of CO and $CO_2$ at a particular temperature and pressure, the fugacity of $O_2$ is fixed at equilibrium by reaction (1). Such $CO/CO_2$ mixtures are referred to as "buffered" mixtures, because the ratio of CO to $CO_2$ in such mixtures can be controlled to adjust (to buffer) the oxygen fugacity at very low values. Indeed, modest additions of CO to $CO_2$ yield quite low values for the equilibrium $O_2$ fugacity. For example, at a temperature of 800° C. and a total pressure of 1 atmosphere (atm), the addition of only 1% CO to $CO_2$ yields an equilibrium oxygen fugacity value of only $3.71\times10^{-15}$ atm (i.e., 0.00371 trillions of an atmosphere or 3.71 quadrillionths of an atmosphere; assuming a hypothetical reference state oxygen fugacity value of 1 atm). At a temperature of 750° C. and a total pressure of 1 atm, the addition of only 1% CO to $CO_2$ yields an equilibrium oxygen fugacity value of only $1.68\times10^{-16}$ atm (i.e., 0.000168 trillions of an atmosphere or 0.168 quadrillionths of an atmosphere; assuming a hypothetical reference state oxygen fugacity value of 1 atm). Because 3 moles of reactant species (2 moles of CO and 1 mole of $O_2$) are consumed to yield only 2 moles of product species (2 moles of $CO_2$) in reaction (1), this reaction should result in a decrease in volume. The negative volume change for this reaction should, in turn, cause the value of the Gibbs free energy of reaction (1), $\Delta G_{rxn(1)}$, to become more negative with an increase in pressure at a fixed temperature; that is, $$\partial\Delta G_{rxn(1)}/\partial P|_T=\Delta V_{rxn}=\text{negative}$$

Hence, an increase in the total pressure should cause reaction (1) to shift to the right, consuming more $O_2$ for a more reducing (lower oxygen fugacity) fluid. Consequently, the equilibrium oxygen fugacity for a mixture of 1% CO in $CO_2$ at 800° C. and a total pressure of 20 MPa should be lower than $3.71\times10^{-15}$ atm (i.e., lower than the oxygen fugacity of 1% CO in $CO_2$ at 800° C. and a total pressure of 1 atm). Similarly, the equilibrium oxygen fugacity for a mixture of 1% CO in $CO_2$ at 750° C. and a total pressure of 20 MPa should be lower than $1.68\times10^{-16}$ atm (i.e., lower than the oxygen fugacity of 1% CO in $CO_2$ at 750° C. and a total pressure of 1 atm). Furthermore, because the critical temperature and critical pressure values for CO are lower than for $CO_2$ (−140° C. and 3.5 MPa for CO vs. 31° C. and 7.4 MPa for $CO_2$), pressure and temperature conditions for which $CO_2$ is supercritical will also be pressure and temperature conditions for which CO is supercritical (i.e., modest CO additions to supercritical $CO_2$ should yield supercritical $CO/CO_2$ mixtures). Hence, a key aspect of the present invention is to provide buffered supercritical fluid mixtures, such as supercritical $CO/CO_2$ fluid mixtures, at high temperatures and high total pressures (>1 atmosphere total pressure) possessing low oxygen fugacities, so as to dramatically lower or eliminate the thermodynamic driving force for oxidative corrosion of materials exposed to such buffered supercritical fluid mixtures.

Consider, as a second non-limiting example, the case of supercritical $H_2O$. $H_2O$ possesses critical temperature and pressure values of 374° C. and 22.1 MPa, respectively. The addition of $H_2$ to supercritical $H_2O$ yields a buffered fluid with an equilibrium oxygen ($O_2$) fugacity established by the following reaction:

$$2H_2+O_2=2H_2O \quad (2)$$

By controlling the relative amounts of $H_2$ and $H_2O$ at a particular temperature and pressure, the fugacity of $O_2$ is fixed at equilibrium by reaction (2). Modest additions of $H_2$ to $H_2O$ yield quite low values for the equilibrium $O_2$ fugacity. For example, at a temperature of 800° C. and a total pressure of 1 atmosphere (atm), the addition of only 1% $H_2$ to $H_2O$ yields an equilibrium oxygen fugacity value of only $4.3\times10^{-15}$ atm (i.e., 0.0043 trillions of an atmosphere or 4.3 quadrillionths of an atmosphere; assuming a reference state oxygen fugacity value of 1 atm). Because 3 moles of reactant species (2 moles of $H_2$ and 1 mole of $O_2$) are consumed to yield only 2 moles of product species (2 moles of $H_2O$) in reaction (2), this reaction should result in a decrease in volume. The negative volume change for this reaction should, in turn, cause the value of the Gibbs free energy of reaction (2), $\Delta G_{rxn(2)}$, to become more negative with an increase in pressure at a fixed temperature; that is, $$\partial\Delta G_{rxn(2)}/\partial P|_T=\Delta V_{rxn}=\text{negative}$$

Hence, an increase in the total pressure should cause reaction (2) to shift to the right, consuming more $O_2$ for a more reducing (lower oxygen fugacity) fluid. Consequently, the equilibrium oxygen fugacity for a mixture of 1% $H_2$ to $H_2O$ at 800° C. and a total pressure of 25 MPa should be lower than $4.3\times10^{-15}$ atm (i.e., lower than the oxygen fugacity of 1% $H_2$ in $H_2O$ at 800° C. and a total pressure of 1 atm). Furthermore, because the critical temperature and pressure values for $H_2$ are lower than for $H_2O$ (−240° C. and 1.3 MPa for $H_2$ vs. 374° C. and 22.1 MPa for $H_2O$), pressure and temperature conditions for which $H_2O$ is supercritical will also be pressure and temperature conditions for which $H_2$ is supercritical (i.e., modest $H_2$ additions to supercritical $H_2O$ should yield supercritical $H_2/H_2O$ mixtures). A key aspect of the present invention is to provide buffered supercritical fluid mixtures, such as supercritical $H_2/H_2O$ fluid mixtures, at high temperatures and high total pressures (>1 atmosphere total pressure) possessing low oxygen fugacities, so as to dramatically lower or eliminate the thermodynamic driving force for oxidative corrosion of materials exposed to such buffered supercritical fluid mixtures.

The oxygen fugacities that can be achieved with buffered supercritical fluid mixtures can be sufficiently low as to remove the thermodynamic driving force for oxidative corrosion of materials; that is, the oxygen fugacities of buffered supercritical fluid mixtures can be sufficiently low as to render materials inert with respect to such buffered supercritical fluid mixtures. Consider, as a first non-limiting example, the exposure of nickel (Ni) to a supercritical fluid mixture comprised of 1% CO with 99% $CO_2$. The oxidation of Ni to form NiO can be expressed by the following reaction:

$$Ni+\tfrac{1}{2}O_2=NiO \quad (3)$$

The equilibrium oxygen fugacity associated with reaction (3) at 800° C. and 1 atm total pressure is $1.20\times10^{-14}$ atm. The equilibrium oxygen fugacity associated with reaction (3) at 750° C. and 1 atm total pressure is $9.14\times10^{--16}$ atm. Hence, the net forward progress of reaction (3) is unfavored at oxygen fugacity values lower than $1.20\times10^{--14}$ atm at 800° C. and 1 atm pressure and is unfavored at oxygen fugacity values lower than $9.14\times10^{--16}$ atm at 750° C. and 1 atm pressure; that is, Ni should not oxidize to form NiO at oxygen fugacity values lower than $1.20\times10^{-14}$ atm at 800° C. and 1 atm total pressure and at oxygen fugacity values lower than $9.14\times10^{-16}$ atm at 750° C. and 1 atm total pressure. As discussed above, the equilibrium oxygen fugacity associated with a mixture of 1% CO with 99% $CO_2$ is $3.71\times10^{-15}$ atm at 800° C. and 1 atm total pressure. The equilibrium oxygen fugacity associated with a mixture of 1% CO with 99% $CO_2$ is $1.7\times10^{--16}$ atm at 750° C. and 1 atm total pressure. Hence, Ni should not oxidize to form NiO upon exposure to a mixture of 1% CO with 99% $CO_2$ at 800° C. and 1 atm total pressure. Ni should also not oxidize to form NiO upon exposure to a mixture of 1% CO with 99% $CO_2$ at 750° C. and 1 atm total pressure. At a total pressure above 1 atm, the equilibrium oxygen fugacity associated with a mixture of 1% CO with 99% $CO_2$ should be lower than $3.71\times10^{-15}$ atm at 800° C. (as discussed above). Similarly, at a total pressure above 1 atm, the equilibrium oxygen fugacity associated with a mixture of 1% CO with 99% $CO_2$ should be lower than $1.68\times10^{-16}$ atm at 750° C. (as discussed above). Hence, Ni should not oxidize to form NiO upon exposure to a supercritical mixture of 1% CO with 99% $CO_2$ at 800° C. and 20 MPa total pressure. Ni should also not oxidize to form NiO upon exposure to a supercritical mixture of 1% CO with 99% $CO_2$ at 750° C. and 20 MPa total pressure. (Note: the equilibrium oxygen fugacity associated with a mixture of 0.56% CO with 99.44% $CO_2$ is $1.20\times10^{-14}$ atm at 800° C. and 1 atm total pressure. The equilibrium oxygen fugacity associated with a mixture of 0.433% CO with 99.569% $CO_2$ is $9.08\times10^{-16}$ atm at 750° C. and 1 atm total pressure. Hence, Ni should not oxidize to form NiO upon exposure to supercritical $CO/CO_2$ mixtures comprised of more than 0.56% CO at 800° C. and 20 MPa total pressure. Ni should also not oxidize to form NiO upon exposure to supercritical $CO/CO_2$ mixtures comprised of more than 0.433% CO at 750° C. and 20 MPa total pressure.) These thermodynamic calculations indicate that Ni can be rendered inert (non-oxidizable) within buffered supercritical $CO/CO_2$ mixtures comprised of sufficient, yet modest, CO contents at elevated temperatures and pressures.

Consider, as another non-limiting example, the exposure of copper (Cu) to a supercritical fluid mixture comprised of 0.01% CO with 99.99% $CO_2$. The oxidation of copper to form $Cu_2O$ can be expressed by the following reaction:

$$2Cu+\tfrac{1}{2}O_2=Cu_2O \quad (4)$$

The equilibrium oxygen fugacity associated with reaction (4) at 800° C. and 1 atm total pressure is $1.63\times10^{-9}$ atm. Hence, the net forward progress of reaction (4) is unfavored at oxygen fugacity values lower than $1.63\times10^{-9}$ atm at 800° C. and 1 atm pressure; that is, Cu should not oxidize to form $Cu_2O$ at oxygen fugacity values lower than $1.63\times10^{-9}$ atm at 800° C. and 1 atm total pressure. The equilibrium oxygen fugacity associated with a mixture of 0.01% CO with 99.99% $CO_2$ is $3.79\times10^{-11}$ atm at 800° C. and 1 atm total pressure. Hence, Cu should not oxidize to form $Cu_2O$ upon exposure to a mixture of 0.01% CO with 99.99% $CO_2$ at 800° C. and 1 atm total pressure. At a total pressure above 1 atm, the equilibrium oxygen fugacity associated with a mixture of 0.01% CO with 99.99% $CO_2$ should be lower than $3.79\times10^{-11}$ atm (as discussed above); that is, Cu should not oxidize to form $Cu_2O$ upon exposure to a mixture of 0.01% CO with 99.99% $CO_2$ at 800° C. and 20 MPa total pressure. (Note: the equilibrium oxygen fugacity associated with a mixture of 0.00153% CO with 99.99847% $CO_2$ is $1.63\times10^{-9}$ atm at 800° C. and 1 atm total pressure. Hence, Cu should not oxidize to form $Cu_2O$ upon exposure to $CO/CO_2$ mixtures comprised of more than 0.00153% CO at 800° C. and 20 MPa total pressure.) These thermodynamic calculations indicate that Cu can be rendered inert (non-oxidizable) within buffered supercritical $CO/CO_2$ mixtures comprised of sufficient, yet low, CO contents at elevated temperatures and pressures.

Consider, as yet another non-limiting example, the exposure of cobalt (Co) to a supercritical fluid mixture comprised of 4% CO with 96% $CO_2$. The oxidation of Co to form CoO can be expressed by the following reaction:

$$Co+\tfrac{1}{2}O_2=CoO \quad (5)$$

The equilibrium oxygen fugacity associated with reaction (5) at 800° C. and 1 atm total pressure is $3.72\times10^{-16}$ atm. Hence, the net forward progress of reaction (5) is unfavored at oxygen fugacity values lower than $3.72\times10^{-16}$ atm at 800° C. and 1 atm pressure; that is, Co should not oxidize to form CoO at oxygen fugacity values lower than $3.72\times10^{-16}$ atm at 800° C. and 1 atm total pressure. The equilibrium oxygen fugacity associated with a mixture of 4% CO with 96% $CO_2$ is $2.18\times10^{-16}$ atm at 800° C. and 1 atm total pressure. Hence, Co should not oxidize to form CoO upon exposure to a mixture of 4% CO with 96% $CO_2$ at 800° C. and 1 atm total pressure. At a total pressure above 1 atm, the equilibrium oxygen fugacity associated with a mixture of 4% CO with 96% $CO_2$ should be lower than $2.18\times10^{-16}$ atm (as discussed above); that is, Co should not oxidize to form CoO upon exposure to a mixture of 4% CO with 96% $CO_2$ at 800° C. and 20 MPa total pressure. (Note: the equilibrium oxygen fugacity associated with a mixture of 3.1% CO with 96.9% $CO_2$ is $3.72\times10^{-16}$ atm at 800° C. and 1 atm total pressure. Hence, Co should not oxidize to form CoO upon exposure to $CO/CO_2$ mixtures comprised of more than 3.1% CO at 800° C. and 20 MPa total pressure.) These thermodynamic calculations indicate that Co can be rendered inert (non-oxidizable) within buffered supercritical $CO/CO_2$ mixtures comprised of sufficient, yet modest, CO contents at elevated temperatures and pressures.

Consider, as another non-limiting example, the exposure of iron (Fe) to a supercritical fluid mixture comprised of 82% CO with 18% $CO_2$. The oxidation of Fe to form FeO can be expressed by the following reaction:

$$Fe+\tfrac{1}{2}O_2=FeO \quad (6)$$

The equilibrium oxygen fugacity associated with reaction (6) at 800° C. and 1 atm total pressure is $1.97\times10^{-20}$ atm. Hence, the net forward progress of reaction (6) is unfavored at oxygen fugacity values lower than $1.97\times10^{-20}$ atm at 800° C. and 1 atm pressure; that is, Fe should not oxidize to form FeO at oxygen fugacity values lower than $1.97\times10^{-20}$ atm at 800° C. and 1 atm total pressure. The equilibrium oxygen fugacity associated with a mixture of 82% CO with 18% $CO_2$ is $1.83\times10^{-20}$ atm at 800° C. and 1 atm total pressure. Hence, Fe should not oxidize to form FeO upon exposure to a mixture of 82% CO with 18% $CO_2$ at 800° C. and 1 atm total pressure. At a total pressure above 1 atm, the equilibrium oxygen fugacity associated with a mixture of 82% CO with 18% $CO_2$ should be lower than $1.83\times10^{-20}$ atm (as per the discussion above); that is, Fe should not oxidize to form FeO upon exposure to a mixture of 82% CO with 18% $CO_2$ at 800° C. and 20 MPa total pressure. (Note: the equilibrium oxygen fugacity associated with a mixture of 81.43% CO with 18.56% $CO_2$ is $1.97\times10^{-20}$ atm at 800° C. and 1 atm total pressure. Hence, Fe should not oxidize to form FeO upon exposure to $CO/CO_2$ mixtures comprised of more than 81.43% CO at 800° C. and 20 MPa total pressure.) If one considers a more oxygen-depleted version of wustite, such as $Fe_{0.947}O$, then the oxidation of iron to form $Fe_{0.947}O$ can be expressed by the following net reaction:

$$0.947Fe+\tfrac{1}{2}O_2=Fe_{0.947}O \quad (7)$$

The equilibrium oxygen fugacity associated with reaction (7) at 800° C. and 1 atm total pressure is $1.10\times10^{-19}$ atm. Hence, the net forward progress of reaction (7) is unfavored at oxygen fugacity values lower than $1.10\times10^{-19}$ atm at 800° C. and 1 atm pressure; that is, Fe should not oxidize to form $Fe_{0.947}O$ at oxygen fugacity values lower than $1.10\times10^{-19}$ atm at 800° C. and 1 atm total pressure. The equilibrium oxygen fugacity associated with a mixture of 82% CO with 18% $CO_2$ is $1.83\times10^{-20}$ atm at 800° C. and 1 atm total pressure. Hence, Fe should not oxidize to form $Fe_{0.947}O$ upon exposure to a mixture of 82% CO with 18% $CO_2$ at 800° C. and 1 atm total pressure. At a total pressure above 1 atm, the equilibrium oxygen fugacity associated with a mixture of 92% CO with 18% $CO_2$ should be lower than $1.83\times10^{-20}$ atm (as per the discussion above); that is, Fe should not oxidize to form $Fe_{0.947}O$ upon exposure to a mixture of 65.0% CO with 35.0% $CO_2$ at 800° C. and 20 MPa total pressure. (Note: the equilibrium oxygen fugacity associated with a mixture of 65.0% CO with 35.0% $CO_2$ is $1.10\times10^{-19}$ atm at 800° C. and 1 atm total pressure. Hence, Fe should not oxidize to form $Fe_{0.947}O$ upon exposure to $CO/CO_2$ mixtures comprised of more than 65.0% CO at 800° C. and 20 MPa total pressure.) These thermodynamic calculations indicate that Fe can be rendered inert (non-oxidizable) within buffered supercritical $CO/CO_2$ mixtures comprised of sufficient CO contents at elevated temperatures and pressures.

Consider, as another non-limiting example, the exposure of nickel (Ni) to a supercritical fluid mixture comprised of 1% $H_2$ with 99% $H_2O$. As mentioned above, the oxidation of Ni to form NiO can be expressed by the net reaction (3). The equilibrium oxygen fugacity associated with reaction (3) at 800° C. and 1 atm total pressure is $1.20\times10^{-14}$ atm. Hence, the net forward progress of reaction (3) is unfavored at oxygen fugacity values lower than $1.20\times10^{-14}$ atm at 800° C. and 1 atm pressure; that is, Ni should not oxidize to form NiO at oxygen fugacity values lower than $1.20\times10^{-14}$ atm at 800° C. and 1 atm total pressure. As mentioned above, the equilibrium oxygen fugacity associated with a mixture of 1% $H_2$ with 99% $H_2O$ is $4.3\times10^{-15}$ atm at 800° C. and 1 atm total pressure. Hence, Ni should not oxidize to form NiO upon exposure to a mixture of 1% $H_2$ with 99% $H_2O$ at 800° C. and 1 atm total pressure. At a total pressure above 1 atm, the equilibrium oxygen fugacity associated with a mixture of 1% $H_2$ with 99% $H_2O$ should be lower than $4.3\times10^{-15}$ atm (as discussed above); that is, Ni should not oxidize to form NiO upon exposure to a mixture of 1% $H_2$ with 99% $H_2O$ at 800° C. and 20 MPa total pressure. (Note: the equilibrium oxygen fugacity associated with a mixture of 0.6% $H_2$ with 99.4% $H_2O$ is $1.17\times10^{-14}$ atm at 800° C. and 1 atm total pressure. Hence, Ni should not oxidize to form NiO upon exposure to $H_2/H_2O$ mixtures comprised of more than 0.6% $H_2$ at 800° C. and 20 MPa total pressure.) These thermodynamic calculations indicate that Ni can be rendered inert (non-oxidizable) within buffered supercritical $H_2/H_2O$ mixtures comprised of sufficient, yet modest, $H_2$ contents at elevated temperatures and pressures.

Consider, as another non-limiting example, the exposure of copper (Cu) to a supercritical fluid mixture comprised of 0.01% $H_2$ with 99.99% $H_2O$. The oxidation of Cu to form $Cu_2O$ can be expressed by the net reaction (4) above. The equilibrium oxygen fugacity associated with reaction (4) at 800° C. and 1 atm total pressure is $1.63\times10^{-9}$ atm. Hence, the net forward progress of reaction (4) is unfavored at oxygen fugacity values lower than $1.63\times10^{-9}$ atm at 800° C. and 1 atm pressure; that is, Cu should not oxidize to form $Cu_2O$ at oxygen fugacity values lower than $1.63\times10^{-9}$ at 800° C. and 1 atm total pressure. The equilibrium oxygen fugacity associated with a mixture of 0.01% $H_2$ with 99.99% $H_2O$ is $4.3\times10^{-11}$ atm at 800° C. and 1 atm total pressure. Hence, Cu should not oxidize to form $Cu_2O$ upon exposure to a mixture of 0.01% $H_2$ with 99.99% $H_2O$ at 800° C. and 1 atm total pressure. At a total pressure above 1 atm, the equilibrium oxygen fugacity associated with a mixture of 0.01% $H_2$ with 99.99% $H_2O$ should be lower than $4.3\times10^{-11}$ atm (as discussed above); that is, Cu should not oxidize to form $Cu_2O$ upon exposure to a mixture of 0.01% $H_2$ with 99.99% $H_2O$ at 800° C. and 20 MPa total pressure. (Note: the equilibrium oxygen fugacity associated with a mixture of 0.00162% $H_2$ with 99.99838% $H_2O$ is $1.63\times10^{-9}$ atm at 800° C. and 1 atm total pressure. Hence, Cu should not oxidize upon exposure to $H_2/H_2O$ mixtures comprised of more than 0.0.00162% $H_2$ at 800° C. and 20 MPa total pressure.) These thermodynamic calculations indicate that Cu can be rendered inert (non-oxidizable) within buffered supercritical $H_2/H_2O$ mixtures comprised of sufficient, yet low, $H_2$ contents at elevated temperatures and pressures.

Consider, as yet another non-limiting example, the exposure of cobalt (Co) to a supercritical fluid mixture comprised of 4% $H_2$ with 96% $H_2O$. The oxidation of Co to form CoO can be expressed by the net reaction (5) above. The equilibrium oxygen fugacity associated with reaction (5) at 800° C. and 1 atm total pressure is $3.72\times10^{-16}$ atm. Hence, the net forward progress of reaction (5) is unfavored at oxygen fugacity values lower than $3.72\times10^{-16}$ atm at 800° C. and 1 atm pressure; that is, Co should not oxidize to form CoO at oxygen fugacity values lower than $3.72\times10^{-16}$ atm at 800° C. and 1 atm total pressure. The equilibrium oxygen fugacity associated with a mixture of 4% $H_2$ with 96% $H_2O$ is $2.5\times10^{-16}$ atm at 800° C. and 1 atm total pressure. Hence, Co should not oxidize to form CoO upon exposure to a mixture of 4% $H_2$ with 96% $H_2O$ at 800° C. and 1 atm total pressure. At a total pressure above 1 atm, the equilibrium oxygen fugacity associated with a mixture of 4% $H_2$ with 96% $H_2O$ should be lower than $2.5\times10^{-16}$ atm (as discussed above); that is, Co should not oxidize to form CoO upon exposure to a mixture of 4% $H_2$ with 96% $H_2O$ at 800° C. and 20 MPa total pressure. (Note: the equilibrium oxygen fugacity associated with a mixture of 3.28% $H_2$ with 96.72% $H_2O$ is $3.72\times10^{-16}$ atm at 800° C. and 1 atm total pressure. Hence, Co should not oxidize to form CoO upon exposure to $H_2/H_2O$ mixtures comprised of more than 3.28% $H_2$ at 800° C. and 20 MPa total pressure.) These thermodynamic calculations indicate that Co can be rendered inert (non-oxidizable) within buffered supercritical $H_2/H_2O$ mixtures comprised of sufficient, yet modest, $H_2$ contents at elevated temperatures and pressures.

Consider, as another non-limiting example, the exposure of iron (Fe) to a supercritical fluid mixture comprised of 83% $H_2$ with 17% $H_2O$. The oxidation of Fe to form FeO can be expressed by the net reaction (6) above. The equilibrium oxygen fugacity associated with reaction (6) at 800° C. and 1 atm total pressure is $1.97\times10^{-20}$ atm. Hence, the net forward progress of reaction (6) is unfavored at oxygen fugacity values lower than $1.97\times10^{-20}$ atm at 800° C. and 1 atm pressure; that is, Fe should not oxidize to form FeO at oxygen fugacity values lower than $1.97\times10^{-20}$ atm at 800° C. and 1 atm total pressure. The equilibrium oxygen fugacity associated with a mixture of 83% $H_2$ with 17% $H_2O$ is $1.80\times10^{-21}$ atm at 800° C. and 1 atm total pressure. Hence, Fe should not oxidize to form FeO upon exposure to a mixture of 83% $H_2$ with 17% $H_2O$ at 800° C. and 1 atm total pressure. At a total pressure above 1 atm, the equilibrium oxygen fugacity associated with a mixture of 83% $H_2$ with 17% $H_2O$ should be lower than $1.80\times10^{-21}$ atm (as discussed above); that is, Fe should not oxidize to form FeO upon exposure to a mixture of 83% $H_2$ with 17% $H_2O$ at 800° C. and 1 atm total pressure. (Note: the equilibrium oxygen fugacity associated with a mixture of 82.35% $H_2$ with 17.65% $H_2O$ is $1.97\times10^{-20}$ atm at 800° C. and 1 atm total pressure. Hence, Fe should not oxidize to form FeO upon exposure to $H_2/H_2O$ mixtures comprised of more than 82.35% $H_2$ at 800° C. and 20 MPa total pressure.) If one considers a more oxygen-depleted version of wustite, such as $Fe_{0.947}O$, then the oxidation of iron to form $Fe_{0.947}O$ can be expressed by the net reaction (7) above. The equilibrium oxygen fugacity associated with reaction (7) at 800° C. and 1 atm total pressure is $1.10\times10^{-19}$ atm. Hence, the net forward progress of reaction (7) is unfavored at oxygen fugacity values lower than $1.10\times10^{-19}$ atm at 800° C. and 1 atm pressure; that is, Fe should not oxidize to form $Fe_{0.947}O$ at oxygen fugacity values lower than $1.10\times10^{-19}$ atm at 800° C. and 1 atm total pressure. The equilibrium oxygen fugacity associated with a mixture of 67% $H_2$ with 33% $H_2O$ is $1.04\times10^{-19}$ atm at 800° C. and 1 atm total pressure. Hence, Fe should not oxidize to form $Fe_{0.947}O$ upon exposure to a mixture of 67% $H_2$ with 33% $H_2O$ at 800° C. and 1 atm total pressure. At a total pressure above 1 atm, the equilibrium oxygen fugacity associated with a mixture of 67% $H_2$ with 33% $H_2O$ should be lower than $1.04\times10^{-19}$ atm (as per the discussion above); that is, Fe should not oxidize to form $Fe_{0.947}O$ upon exposure to a mixture of 67% $H_2$ with 33% $H_2O$ at 800° C. and 20 MPa total pressure. (Note: the equilibrium oxygen fugacity associated with a mixture of 66.36% $H_2$ with 33.64% $H_2O$ is $1.10\times10^{-19}$ atm at 800° C. and 1 atm total pressure. Hence, Fe should not oxidize to form $Fe_{0.947}O$ upon exposure to $H_2/H_2O$ mixtures comprised of more than 66,36% $H_2$ at 800° C. and 20 MPa total pressure.) These thermodynamic calculations indicate that Fe can be rendered inert (non-oxidizable) within buffered supercritical $H_2/H_2O$ mixtures comprised of sufficient $H_2$ contents at elevated temperatures and pressures.

Buffered supercritical mixtures, other than buffered supercritical $CO/CO_2$ and buffered $H_2/H_2O$ mixtures, may also be used at elevated temperatures and pressures so as to render solid materials inert with such buffered supercritical mixtures. Such buffered supercritical mixtures can include mixtures that achieve low fugacities for oxidants other than oxygen. Non-limiting examples of such buffered supercritical mixtures with low fugacities for a non-oxygen oxidant are buffered supercritical $H_2$/HCl mixtures that can achieve low chlorine ($Cl_2$) fugacities, buffered supercritical $H_2/H_2S$ mixtures that can achieve low sulfur fugacities, and buffered supercritical $H_2/NH_3$ mixtures that can achieve low nitrogen ($N_2$) fugacities.

Tests of the corrosion of nickel (Ni) specimens in supercritical mixtures of CO in $CO_2$ using the concept of the present invention provided by Purdue University have been conducted using the autoclave system at the University of Wisconsin at the request of Purdue University. (Note: such an autoclave system is a known means of achieving high gas pressures at high temperatures, such as achieving a high pressure for a mixture of CO in $CO_2$ at a high temperature. Such corrosion testing equipment and methods used in this testing and corrosion tests described earlier in this detailed description are known to those skilled in the art.) The idea of using a buffered supercritical $CO/CO_2$ mixture at elevated temperatures and pressures to render materials, such as nickel and copper, inert with respect to such buffered supercritical mixtures was conceived prior to these tests at the University of Wisconsin. Gas mixtures were prepared with 1±0.2% CO in $CO_2$, as verified with a gas chromatograph (Varian). A polished high-purity nickel specimen was exposed to such a $CO/CO_2$ mixture at 750° C. at a total pressure of 20 MPa (2900 psi) and an average flow rate of ~0.10 kilograms/hour for 24 hours. The nickel specimen did not exhibit the formation of a scale of nickel oxide, NiO, after such 24 hour exposure to the supercritical 1±0.2% $CO/CO_2$ mixture at 750° C. and a total pressure of 20 MPa. This experiment is consistent with the thermodynamic calculations above, which indicated that Ni should not oxidize to form NiO upon exposure to a supercritical $CO/CO_2$ mixture containing more than 0.433% CO at 750° C. and a total pressure of 20 MPa (in excess of 1 atm).

Buffered supercritical mixtures may also be used at elevated temperatures and pressures to reduce the thermodynamic driving for reaction with oxidizable materials; that is, even if oxidation of a material upon exposure to a buffered supercritical mixture is thermodynamically favored, the rate of oxidation of such a material can be appreciably lower in the presence of such a buffered supercritical mixture than in a non-buffered supercritical mixture (due to the reduction in the thermodynamic driving force for such oxidation in the buffered supercritical mixture relative to a non-buffered supercritical mixture). Consider, as a non-limiting example, the oxidation of chromium (Cr) via the following net reaction at 750° C.:

$$2Cr+3/2O_2 = Cr_2O_3 \quad (8)$$

The equilibrium oxygen fugacity associated with reaction (8) at 750° C. and 1 atm total pressure is $2.34\times10^{-30}$ atm. Hence, the net forward progress of reaction (8) is favored at oxygen fugacity values greater than $2.34\times10^{-30}$ atm at 750° C. and 1 atm pressure; that is, Cr should oxidize to form $Cr_2O_3$ at oxygen fugacity values greater than $2.34\times10^{-30}$ atm at 750° C. and 1 atm total pressure. Consider a $CO/CO_2$ mixture comprised of 1% CO and 99% $CO_2$ at 750° C. and 1 atm total pressure. As mentioned above, the equilibrium oxygen fugacity associated with a mixture of 1% CO and 99% $CO_2$ at 750° C. and 1 atm total pressure is $1.68\times10^{-16}$ atm, which is a factor of $7.2\times10^{13}$ (i.e., a factor of 72 trillion) times greater than the equilibrium oxygen fugacity associated with reaction (8) at 750° C. and 1 atm total pressure. Hence, reaction (8) should proceed spontaneously to the right upon exposure of Cr to a mixture of 1% CO and 99% $CO_2$ at 750° C. and 1 atm total pressure. While the oxygen fugacity associated with a mixture of 1% CO and 99% $CO_2$ at 750° C. at 20 MPa should be greater than $1.68\times10^{-16}$ atm, it is expected that this oxygen fugacity value will still be much greater than the equilibrium oxygen fugacity associated with reaction (8) at 750° C. and 20 MPa total pressure; that is, it is expected that Cr will oxidize to form $Cr_2O_3$ upon exposure to a supercritical mixture of 1% CO and 99% $CO_2$ at 750° C. at 20 MPa. However, the oxygen fugacity of a supercritical mixture of 1% CO and 99% $CO_2$ at 750° C. at 20 MPa will be much lower than the oxygen fugacity of unbuffered, high-purity $CO_2$ under these conditions. A commercial high-purity grade of $CO_2$ will contain an oxygen impurity content in excess of $1\times10^{-9}$ atm (greater than 1 part per billion of $O_2$ relative to $CO_2$). An oxygen fugacity of $1\times10^{-9}$ atm is a factor of $5.95\times10^{6}$ (a factor 5.95 million) times greater than the oxygen fugacity associated with the equilibrium of a mixture of 1% CO and 99% $CO_2$ at 750° C. at 1 atm total pressure. It is expected that the ratio of the oxygen fugacity associated with the equilibrium of a mixture of 1% CO and 99% $CO_2$ at 750° C. at 20 MPa total pressure to an oxygen fugacity of $1\times10^{-9}$ atm will be even greater than $5.95\times10^{6}$. Hence, while the exposure of Cr to a supercritical mixture of 1% CO and 99% $CO_2$ at 750° C. and 20 MPa total pressure is expected to result in the formation of $Cr_2O_3$, the thermodynamic driving force for such $Cr_2O_3$ formation in the presence of a supercritical mixture of 1% CO and 99% $CO_2$ at 750° C. and 20 MPa should be much lower than for the formation of $Cr_2O_3$ in the presence of unbuffered commercial high-purity $CO_2$ at 750° C. and 20 MPa.

Tests of the corrosion of a nickel alloy specimen and an iron alloy specimen in supercritical mixtures of CO in $CO_2$ using the concept of the present invention provided by Purdue University have been conducted using the autoclave system at the University of Wisconsin at the request of Purdue University. (Note: such an autoclave system is a known means of achieving high gas pressures at high temperatures, such as achieving a high pressure for a mixture of CO in $CO_2$ at a high temperature. Such corrosion testing equipment and methods used in this testing and corrosion tests described earlier in this detailed description are known to those skilled in the art.) The idea of using a buffered supercritical $CO/CO_2$ mixture at elevated temperatures and pressures to appreciably lower the thermodynamic driving force for the oxidation of materials, such as nickel alloys and iron alloys, relative to unbuffered supercritical mixtures was conceived prior to these tests and prior to the submission of a concept white paper to the U.S. Department of Energy in November, 2014 (submission date). Gas mixtures were prepared with 1±0.2% CO in $CO_2$, as verified with a gas chromatograph (Varian). Polished specimens of Haynes 230 (H230) alloy (comprised of 57 weight percent {wt %} Ni, 22 wt % Cr, 14 wt % W, 2 wt % Mo, ≤3 wt % Fe, ≤5 wt % Co, 0.5 wt % Mn, 0.4 wt % Si, 0.3 wt % Al, 0.10 wt % C, 0.02 wt % La, ≤0.015 wt % B) and of 316 stainless (316SS) steel (≥62 wt % Fe, 16-18 wt % Cr, 10-14 wt % Ni, 2-3 wt % Mo, ≤2 wt % Mn, ≤0.75 wt % Si, ≤0.08 wt % C, ≤0.045 wt % P, ≤0.10 wt % N) were exposed to such a $CO/CO_2$ mixture at 750° C. at a total pressure of 20 MPa (2900 psi) and an average flow rate of ~0.10 kilograms/hour for 24 hours. The H230 and 316SS specimens retained their shapes after such 24 hour exposure to the supercritical 1±0.2% $CO/CO_2$ mixture at 750° C. and a total pressure of 20 MPa, but did exhibit slightly positive weight change values (on the order of $10^{-5}$ mg/mm$^2$) that were comparable to the ±two-sigma error range of the measurements; that is, within a ±two-sigma error range, these specimens exhibited essentially no oxidative weight gain, presumably due to the formation of a slow-growing, very thin external $Cr_2O_3$ scale. Hence, while thermodynamic calculations suggest that elements like Cr may oxidize in such alloys, the reduction in the thermodynamic driving force for such oxidation via the use of a buffered supercritical $CO/CO_2$ mixture (instead of commercial high-purity supercritical $CO_2$) can dramatically lower the rate of oxidation of such elements in such alloys.

Another aspect of this invention is the use of metal or metal alloy layers placed on oxidizable materials, along with buffered supercritical mixtures, to dramatically lower the rate of oxidation of such oxidizable materials in such supercritical fluids. Consider, as a first non-limiting example, the placement of a nickel (Ni) layer on a composite of zirconium carbide (ZrC) and tungsten (W) exposed to a buffered supercritical mixture of 1% CO and 99% $CO_2$ at 750-800° C. and a total pressure of 20 MPa. The following calculation indicates that a layer of Ni on such a ZrC/W composite exposed to a buffered supercritical 1% CO/99% $CO_2$ fluid at 750° C.-800° C. and a total pressure of 20 MPa can dramatically slow the oxygen flux to, and oxidation of, the underlying ZrC/W composite relative to the oxidation of an uncoated ZrC/W composite exposed to commercially pure $CO_2$ at 750° C.-800° C. and a total pressure of 20 MPa; that is, the rate of transport of oxygen through a Ni layer to the underlying ZrC/W composite can be sufficiently slow as to dramatically reduce the rate of oxidation of the underlying ZrC/W composite relative to the oxidation of an uncoated ZrC/W composite exposed to commercially pure $CO_2$ at 750° C.-800° C. and a total pressure of 20 MPa. As mentioned above, the addition of 1% CO to $CO_2$ at 800° C. and a total pressure of 1 atm reduces the equilibrium oxygen fugacity to $3.71\times10^{-15}$ atm, which is sufficiently low as to avoid Ni oxidation under these conditions (NiO formation requires an oxygen fugacity>$1.20\times10^{-14}$ atm at 800° C., 1 atm). Similarly, the addition of 1% CO to $CO_2$ at 750° C. and a total pressure of 1 atm reduces the equilibrium oxygen fugacity to $1.68\times10^{-16}$ atm, which is sufficiently low as to avoid Ni oxidation under these conditions (NiO formation requires an oxygen fugacity>$9.14\times10^{-16}$ atm at 750° C., 1 atm). A $CO/CO_2$ mixture equilibrated at higher pressures (e.g., 20 MPa) should be even more reducing than for the same mixture at 1 atm pressure (since the volume change upon reaction of CO with $O_2$ to form $CO_2$ is negative, so that the Gibbs free energy change of this reaction should become more negative with an increase in absolute pressure). The diffusivity and oxygen solubility of oxygen in nickel are given by:

$$D_O(\text{cm}^2/\text{sec})=4.9\times10^{-2}\exp\{-164{,}000\ \text{J/RT}\}$$

$$\text{Co(at \%)}=2.38\times10^{-4}(f_{O2})^{1/2}\exp\{182{,}000\ \text{J/RT}\},$$ with $f_{O2}$ expressed in atm $S_O$ at 750° C. and 800° C.:

$$D_O(\text{cm}^2/\text{sec})=2.07\times10^{-10}\ \text{cm}^2/\text{sec}(750°\ \text{C.});\quad D_O=5.09\times10^{-10}\ \text{cm}^2/\text{sec}(800°\ \text{C.})$$

$$C_O(\text{at \%})=4.67\times10^5(f_{O2})^{1/2}(750°\ \text{C.});\quad C_O=1.72\times10^5(f_{O2})^{1/2}(800°\ \text{C.})$$

The values of the standard Gibbs free energy change per mole of the reaction:

$$2CO+O_2(g)=2CO_2 \tag{1}$$

at 750° C. and 1 atm total pressure, and at 800° C. and 1 atm total pressure are: −193,551 J and −189,208 J, respectively. Hence, the values of the equilibrium oxygen fugacity for this reaction with a $f_{CO2}/f_{CO}$ ratio of 99/1 (1% CO in $CO_2$) at 750° C. and 800° C. are $1.68\times10^{-16}$ atm and $3.71\times10^{-15}$ atm, respectively. Thus, the values of the oxygen concentration dissolved in Ni in equilibrium with such a 1% CO/99% $CO_2$ mixture at 750° C. and 800° C. are:

$C_O$=0.00605 at %(750° C.); $C_O$=0.0105 at %(800° C.) or $X_o$ (mole fraction of oxygen in Ni)=$6.05\times10^{-5}$(750° C.); $X_o=1.05\times10^{-4}$ (800° C.) Consider a layer of Ni on top of a ZrC/W composite in such a $CO/CO_2$ environment. For a linear concentration gradient of oxygen through the Ni layer under steady-state conditions, the inward flux of oxygen through such a Ni layer may be expressed as:

$$Jo(\text{moles O/cm}^2\text{-sec})=-D_O\Delta X_O/\{LV_m(\text{Ni})\}$$

where $\Delta X_o$ is the difference in mole fraction of oxygen dissolved in Ni at the Ni:$CO/CO_2$ interface and at the Ni:ZrC/W interface; L is the thickness of the Ni layer; and $V_m$(Ni) is the molar volume (cm$^3$/mole) of Ni. The maximum oxygen flux would occur if the mole fraction of oxygen dissolved in Ni at the Ni:ZrC/W interface is assumed to be zero. Hence, the maximum inward oxygen flux is given by:

$$Jo(\text{max})=D_OX_o/\{LV_m(\text{Ni})\}$$

The molar volume of Ni (at room temperature) is 6.589 cm$^3$/mole. The maximum values of the steady-state flux of oxygen through a Ni layer of 100 micrometers (100 □m or 0.01 cm) thickness at 750° C. and at 800° C. in a 1% $CO/CO_2$ environment are thus:

$$J_O(\text{max})=1.9\times10^{-13}\ \text{moles O/cm}^2\text{-sec}(750°\ \text{C.})$$

$$J_O(\text{max})=8.1\times10^{-13}\ \text{moles O/cm}^2\text{-sec}(800°\ \text{C.})$$

In 30 years ($9.46\times10^8$ sec), $1.8\times10^{-4}$ and $7.7\times10^{-4}$ moles of 0 per cm$^2$ (or effectively $9.0\times10^{-5}$ moles and $3.9\times10^{-4}$ moles of $O_2$/cm$^2$) would migrate through such a Ni layer at 750° C. and 800° C., respectively. Suppose that all of this oxygen is used to form $ZrO_2$ (note: ZrC has a much higher affinity for oxygen than W). The molar volume of monoclinic $ZrO_2$ (the stable form of $ZrO_2$ at 750° C. and 800° C.) is 21.18 cm$^3$/mole. If it is assumed that a layer of monoclinic $ZrO_2$ forms at the Ni:ZrC/W interface, then the oxygen flux values calculated above would yield $1.9\times10^{-3}$ cm and $8.3\times10^{-3}$ cm (19 μm and 83 μm) of $ZrO_2$ scale in 30 years (about 0.63 μm and 2.7 μm of $ZrO_2$ per year). If a 10 μm thick Ni layer is placed on a ZrC/W composite, then 10 times more $ZrO_2$ would be generated (about 6.3 μm and 28 μm of $ZrO_2$ per year at 750° C. and 800° C., respectively). These calculations indicate that the flux of oxygen through a ≥10 μm layer of inert Ni should be sufficiently low in a 1% $CO/CO_2$ mixture at 750° C. and 800° C. as to achieve a very low corrosion rate of <30 μm per year.

Another non-limiting example is placement of a Haynes 230 (H230) nickel alloy layer on a composite of zirconium carbide (ZrC) and tungsten (W) exposed to a buffered supercritical mixture of 1% CO and 99% $CO_2$ at 750-800° C. and a total pressure of 20 MPa. A H230 alloy is expected to form a slow-growing external $Cr_2O_3$ scale upon exposure buffered supercritical mixture of 1% CO and 99% $CO_2$ at 750-800° C. and a total pressure of 20 MPa. Indeed, as mentioned above, a H230 specimen retained its shape after such 24 hour exposure to a supercritical 1±0.2% $CO/CO_2$ mixture at 750° C. and a total pressure of 20 MPa, with a slightly positive weight change (on the order of $10^{-5}$ mg/mm$^2$) that was comparable to the ±two-sigma error range of the measurements; that is, within a ±two-sigma error range, this specimen exhibited essentially no oxidative weight gain, presumably due to the formation of a slow-growing, thin external $Cr_2O_3$ scale. Hence, in addition to slowing the transport of oxygen to the underlying ZrC/W composite via oxygen diffusion through the H230 layer, such a H230 alloy layer can consume some of the oxygen to form a slow-growing $Cr_2O_3$ scale. As a result, such a H230 alloy layer placed on a ZrC/W composite that is then exposed to a supercritical mixture of 1% CO and 99% $CO_2$ at 750-800° C. and a total pressure of 20 MPa should exhibit an even slower rate of oxidation of the underlying ZrC/W composite than for the case of a pure Ni layer placed on a ZrC/W composite exposed to the supercritical mixture of 1% CO and 99% $CO_2$ at 750-800° C. and a total pressure of 20 MPa.

Figure 2A:
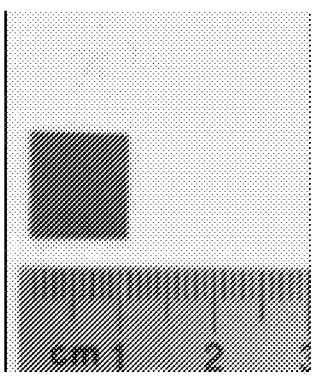
FIG. 2A shows a polished ZrC/W plate.
Figure 2B:
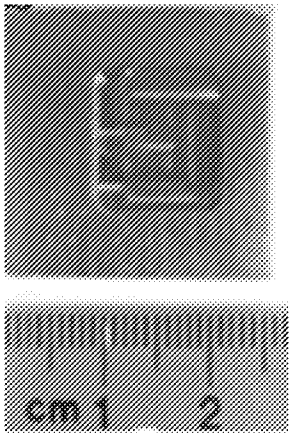
FIG. 2B shows an image of Cu plate with a machined cavity.
Figure 2C:
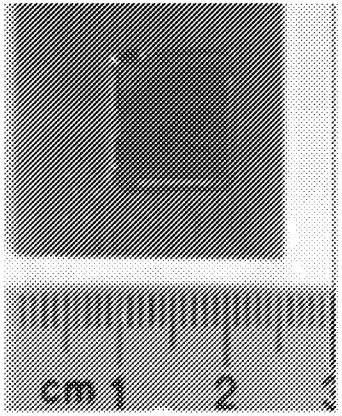
FIG. 2C shows an image of the Cu plate with the ZrC/W plate in the cavity.
Figure 2D:
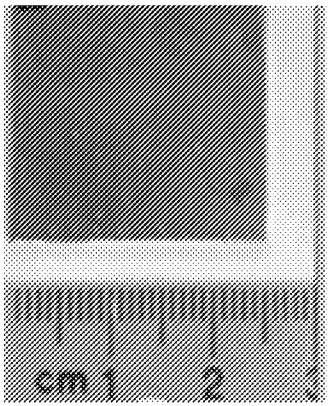
FIG. 2D shows an image of aCu foil placed on top of the ZrC/W in the cavity.
Figure 2E:
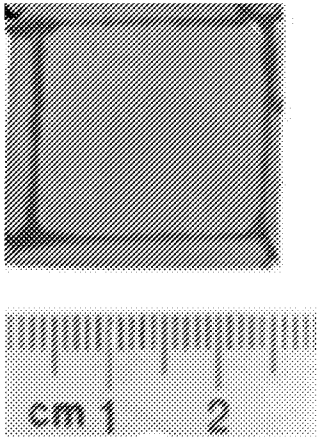
FIG. 2E shows an image of Cu-encapsulated ZrC/W after diffusion bonding.

Additional experiments to substantiate the approaches outlined above will now be described. FIG. 1 shows one example of ZrC/W plates (1 cm×1 cm×1 mm) which are diffusion bonded to, and encapsulated within, Cu. Each ZrC/W plate was placed in a 1 mm deep square cavity that had been cut into a 3 mm thick Cu plate. A 1 mm thick Cu foil was then diffusion bonded to the ZrC/W plate and the Cu plate at 920° C. and 10 MPa for 2 h. Images obtained at different stages of the copper encapsulation process are shown in FIGS. 2A through 2E. FIG. 2A shows a polished ZrC/W plate, FIG. 2B shows an image of a Cu plate with a machined cavity, FIG. 2C shows an image of the Cu plate with the ZrC/W plate in the cavity, FIG. 2D shows an image of a Cu foil placed on top of the ZrC/W in the cavity, and FIG. 2E shows an image of Cu-encapsulated ZrC/W after diffusion bonding. The hermetic nature of such metal encapsulation for two such Cu-encased ZrC/W specimens was confirmed via oxidation experiments conducted at 750° C. and 0.1 MPa at the equilibrium $Cu/Cu_2O$ oxygen partial pressure (obtained with the use of a $Cu/Cu_2O$ Rhines pack mixture), and these samples were then exposed to 50 ppm SCO in $SCO_2$ at 750° C. and 20 MPa for 200 h, 600 h, and 1000 h, as described below. (Note: In this disclosure the notation SCO stands for supercritical CO and the notation $SCO_2$ stands for supercritical $CO_2$.)

To confirm the hermiticity of the encapsulation, the Cu-encased ZrC/W ceramic/metal composite (cermet), along with uncoated Cu, and uncoated ZrC/W specimens were sealed in an ampoule in $O_2$-gettered Ar with an excess (Rhines pack) mixture of Cu and $Cu_2O$. (Note: a Rhines pack mixture refers to a mixture of two or more condensed phases that can react so as to generate an equilibrium fugacity of an oxidizing gas species, or equilibrium partial pressure of an oxidizing gas species, at a low but controlled value at a particular temperature. An example of a Rhines pack mixture is a powder mixture of Cu and $Cu_2O$ that can equilibrate to yield a low but controlled oxygen partial pressure at a given temperature.) The $Cu/Cu_2O$ mixture was used to fix the oxygen partial pressure ($pO_2$) at 750° C. to a value of $2.6\times10^{-10}$ atm. Under these conditions, Cu should be noble, whereas ZrC and W were both capable of being oxidized. Weight change measurements and visual observations after 30 min exposure at 750° C. to a μm of $2.6\times10^{-10}$ atm indicated that the Cu-encased ZrC/W specimens were hermetically sealed; that is, uncoated ZrC/W specimens exhibited appreciable weight gains of 26±14 mg/cm$^2$, whereas the Cu-encased ZrC/W specimens exhibited slight weight losses (0.6, 3.6 mg for two 23 g samples) possibly due to reduction of copper oxide/hydroxide present as a slight tarnish and/or due to organic pyrolysis (from adhesive used to prepare the specimens prior to diffusion bonding).

Figure 3B:
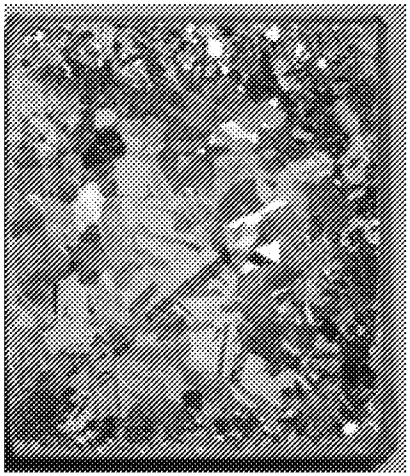
FIG. 3B Cu-encased ZrC/W after 1000 h of exposure to 50 ppm $SCO/SCO_2$ at 750° C./20 MPa. This figure reveals the opposite side of the Cu-encased ZrC/W specimen shown in FIG. 3A.
Figure 3A:
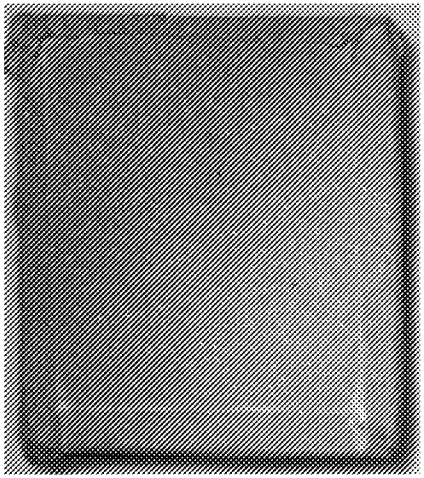
FIG. 3A Cu-encased ZrC/W after 1000 h of exposure to 50 ppm $SCO/SCO_2$ at 750° C./20 MPa.
Figure 4B:
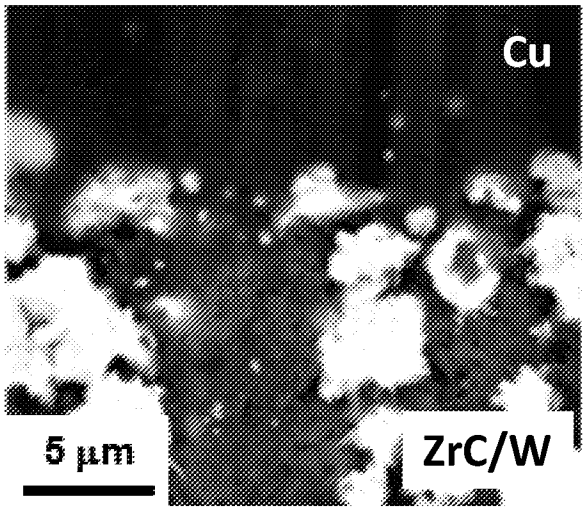
FIGS. 4A and 4B are BSE (backscattered electron microscopy) images of a polished cross-section of a Cu-encased ZrC/W specimen after 1000 h of exposure to 50 ppm $SCO/SCO_2$ at 750° C./20 MPa. The image in FIG. 4B was obtained from the same specimen cross-section as in FIG. 4A but the image in FIG. 4B was obtained at a higher magnification and with a higher contrast than for the image in FIG. 4A.
Figure 4A:
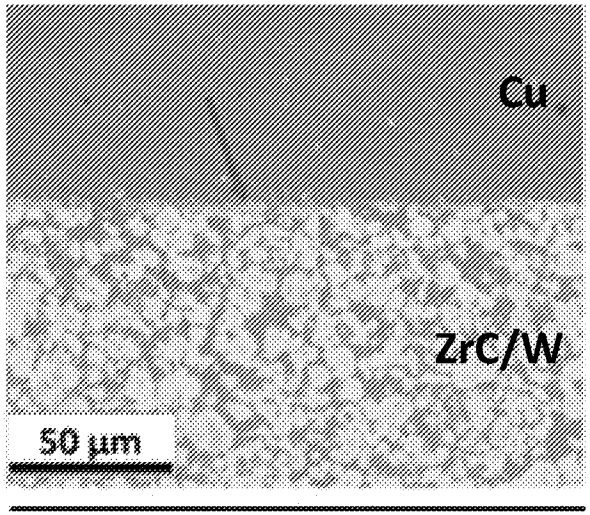
Figure 4D:
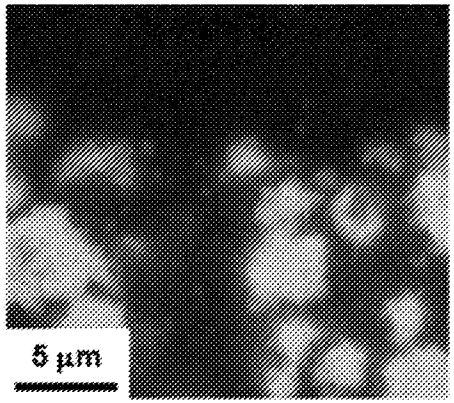
FIGS. 4C, 4D, 4E, and 4F are elemental maps for Cu, W, O, and Zr, respectively, obtained from a polished cross-section of a Cu-encased ZrC/W specimen after 1000 h of exposure to 50 ppm $SCO/SCO_2$ at 750° C./20 MPa.
Figure 4F:
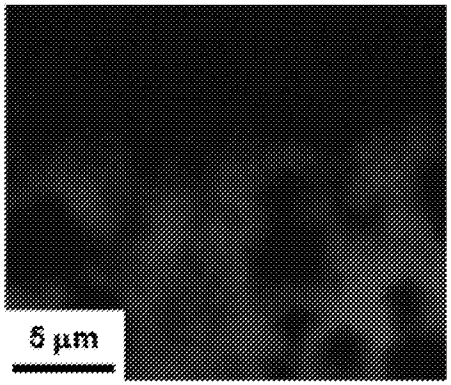
Figure 4C:
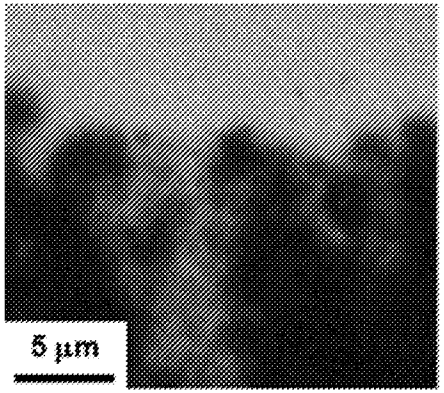
Figure 4E:
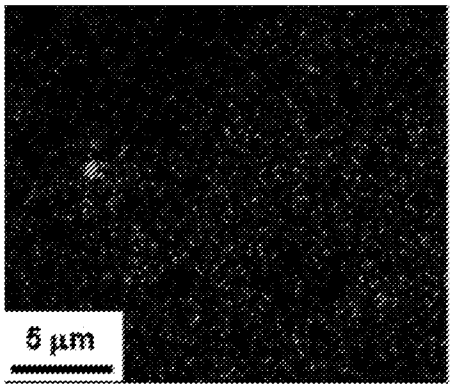

Two Cu-encased ZrC/W specimens were then subjected to corrosion testing in an autoclave system in supercritical mixtures of CO in $CO_2$ (a proposed reducing supercritical fluid). These tests were conducted using the autoclave system at the University of Wisconsin at the request of Purdue University using the concept of the present invention provided by Purdue University. (Note: such an autoclave system is a known means of achieving high gas pressures at high temperatures, such as achieving a high pressure for a mixture of CO in $CO_2$ at a high temperature. Such corrosion testing equipment and methods used in this testing and corrosion tests described earlier in this detailed description are known to those skilled in the art.) The idea of using a buffered supercritical $CO/CO_2$ mixture at elevated temperatures and pressures to appreciably lower the thermodynamic driving force for the oxidation of materials, such as nickel alloys and iron alloys, relative to unbuffered supercritical mixtures was conceived prior to these tests and prior to the submission of a concept white paper to the U.S. Department of Energy in November, 2014 (submission date). Gas mixtures containing 50±10 ppm CO in $CO_2$, as evaluated with a gas chromatograph (Varian), were prepared for such tests. The two Cu-encased ZrC/W samples, along with samples of Ni200 (high purity Ni), Cu110 (commercially pure Cu), and the alloys H230 and SS316, were tested in such $CO/CO_2$ mixtures at 750° C., a total pressure of 20 MPa (2900 psi), and an average flow rate of ~0.10 kg/h for 1000 h. An alumina rod and spacers were used to hold samples in place, with ZrC/W specimens secured to the alumina rod via Ni wire. Images of the both sides of a Cu-enclosed ZrC/W specimen after exposure to flowing 50±10 ppm $CO/CO_2$ mixtures at 750° C./20 MPa for 1000 h are shown in FIGS. 3A and 3B. These samples exhibited no visible external corrosion and weight change measurements indicated slight weight losses of 4.0 and 8.7 mg after 1000 h of exposure to 50 ppm $CO/CO_2$ at 750° C./20 MPa (which may have been due to the reduction of some tarnish on the Cu and/or to organic pyrolysis, as discussed above). The specimens were then cross-sectioned for examination of the interfaces between the 1 mm thick Cu foil coating and the ZrC/W cermet. FIGS. 4A and 4B are BSE (backscattered electron microscopy) images of a polished cross-section of a Cu-encased ZrC/W specimen after 1000 h of exposure to 50 ppm $SCO/SCO_2$ at 750° C. and 20 MPa. The image in FIG. 4B was obtained from the same specimen cross-section as in FIG. 4A, but the image in FIG. 4B was obtained at a higher magnification and with a higher contrast than for the image in FIG. 4A. FIGS. 4C, 4D, 4E, and 4F are elemental maps for Cu, W, O, and Zr, respectively, obtained from a polished cross-section of a Cu-encased ZrC/W specimen after 1000 h of exposure to 50 ppm $SCO/SCO_2$ at 750° C./20 MPa. FIGS. 4C, 4D, 4E, and 4F were obtained at the same location on the specimen cross-section as the backscattered electron image shown in FIG. 4B. The O and Zr maps indicate the presence of a very small amount of zirconium oxide (a single O-rich location in FIG. 4E) at the interface between the Cu layer and ZrC/W. The lack of a detectable weight gain, excellent retention of the sample morphology, and the very small amount of discontinuous oxide formed at the interface between the 1 mm thick Cu foil and the ZrC/W cermet indicated that Cu can be an effective barrier to the corrosion of ZrC/W in 50 ppm $SCO/CO_2$ mixtures at 750° C. and 20 MPa. It is worth noting that such corrosion protection over 1000 h was achieved with 4 thermal cycles between 750° C. and room temperature; that is, 2 such thermal cycles were conducted on the Cu-encased ZrC/W samples prior to $SCO/CO_2$ tests (once with diffusion bonding and once with Rhines pack testing), and 2 additional cycles were conducted (after the 200 h and 600 h points) prior to the final 1000 h stage of the $SCO/CO_2$ tests.

While thermodynamic calculations indicate that Cu should be thermodynamically stable (inert) in a 50 ppm $CO/CO_2$ mixture at 750° C., it is possible for atomic oxygen (formed at the external Cu surface) to migrate through the Cu layer to reach the Cu/cermet interface and then preferentially oxidize the ZrC phase. Kinetic analysis has been conducted to evaluate oxygen migration through Cu layers during exposure to such $CO/CO_2$ mixture at 750° C. The addition of 50 ppm CO to $CO_2$ at 750° C., 1 atm reduces the equilibrium oxygen fugacity to $6.87\times10^{-12}$ atm, which is sufficiently low as to avoid Cu oxidation (note: $Cu_2O$ formation requires an oxygen fugacity>$2.60\times10^{-10}$ atm at 750° C., 1 atm). A $CO/CO_2$ mixture equilibrated at higher pressures (e.g., 20 MPa) should be even more reducing than for the same mixture at 1 atm pressure (since the volume change upon reaction of CO with $O_2$ to form $CO_2$ is negative, so that the Gibbs free energy change of this reaction should become more negative with an increase in absolute pressure). The diffusivity ($D_O$) and solubility ($X_O$) of oxygen in Cu at 750° C. are given by:

$$D_O(\text{cm}^2/\text{sec})=4.25\times10^{-6} \quad \text{cm}^2/\text{sec}$$
$$X_O(\text{at fraction})=4.67\times05(_{pO2})^{1/2}$$

According to Sievert's law (which applies for low oxygen contents where Henry's law is valid, as should be the case here), the solubility of a diatomic gas in a condensed phase should vary with the square root of the gas partial pressure. Hence the solubility of oxygen in Cu that is equilibrated with a 50 ppm $CO/CO_2$ mixture should be (ignoring non-ideal behavior for the $CO/CO_2$ mixture):

$$X_O[\text{at fraction for 50 ppm } CO/CO_2]/X_O[\text{at fraction for } Cu/Cu_2O]=\{6.87\times10^{-12}/2.60\times10^{-10}\}^{1/2}$$

$$\text{or } X_O(\text{at fraction for 50 ppm } CO/CO_2)/3.54\times10^{-6}=\{6.87\times10^{-12}/2.60\times10^{-10}\}^{1/2}$$

$$\text{or } X_O(\text{at fraction for 50 ppm } CO/CO_2)=5.75\times10^{-7}$$

Consider a layer of Cu on top of ZrC/W in such a 50 ppm $CO/CO_2$ atmosphere. If a linear gradient is assumed for the oxygen concentration through the Cu layer under steady-state conditions (i.e., assuming that the oxygen diffusion in copper is independent of the oxygen concentration and that the chemical reactions at both the Cu:ZrC/W and Cu:CO—$CO_2$ interfaces are at local equilibrium), then the flux of oxygen through such a Cu layer may be expressed as:

$$J_O(\text{moles O/cm}^2\text{-sec})=-D_O\Delta X_O/\{LV_m(Cu)\}$$

where $\Delta X_o$ is the difference in mole fraction of oxygen dissolved in Cu at the Cu:CO—$CO_2$ interface and at the Cu:ZrC/W interface; L is the thickness of the Cu layer; and $V_m(Cu)$ is the molar volume ($cm^3$/mole) of Cu. The maximum flux of oxygen would occur if it is assumed that the mole fraction of oxygen dissolved in Cu at the Cu/ZrC≥W interface is zero (or essentially zero). Hence, the maximum oxygen flux is given by:

$$J_O(\max)=-D_OX_o/\{LV_m(Cu)\}$$

The molar volume of Cu (at room temperature) is 7.113 $cm^3$/mole. The maximum steady-state flux of oxygen through a Cu layer of 1000 μm (1 mm) thickness at 750° C. in a 50 ppm $CO/CO_2$ environment is thus:

$$J_O(\max)=3.44\times10^{-12} \text{ moles O/cm}^2\text{-sec}$$

In 1000 h ($3.60\times10^6$ sec), $1.24\times10^{-5}$ moles of 0 per $cm^2$ (or effectively $6.19\times10^{-6}$ moles of $O_2/cm^2$) would migrate through such a Cu layer. Suppose that all of this oxygen were used to generate $ZrO_2$. The molar volume of monoclinic $ZrO_2$ (the stable form of $ZrO_2$ at 800° C.) is 21.18 $cm^3$/mole. If it is assumed that a layer of monoclinic $ZrO_2$ forms at the Cu:ZrC/W interface, then the oxygen flux calculated above would yield $1.3\times10^{-4}$ cm=1.3 μm of $ZrO_2$ scale in 1000 h. This value is consistent with the very small, discontinuous amount of apparent $ZrO_2$ observed in the oxygen map in FIG. 4E. In 1 year ($3.15\times10^7$ sec), the corresponding $ZrO_2$ thickness would be 11.4 μm (below the 30 μm success metric). Since the oxygen flux is inversely proportional to the Cu layer thickness, a Cu layer of thickness>380 μm (0.38 mm) would be needed for <30 μm of $ZrO_2$ formation in 1 year.

As described earlier, A similar calculation for $Cr_2O_3$ (29.06 $cm^3$/mole) formation (on Ni-based or Fe-based alloys) via oxygen diffusion through Cu layer would yield $Cr_2O_3$ thicknesses of 210 μm (for a 100 μm thick Cu layer) and 30 μm (for a 700 μm thick Cu layer). These calculations assume that the rate-limiting steps for $ZrO_2$ and $Cr_2O_3$ scale formation are oxygen diffusion through the Cu layer, which is unlikely for a $Cr_2O_3$ scale (i.e., mass transport through a compact $Cr_2O_3$ layer is more likely the rate-limiting step) and possibly also not the case for the $ZrO_2$ scale. These calculations also ignore any non-ideal fluid behavior for a high pressure mixture of $CO/CO_2$. Nonetheless, these calculations indicate a significant reduction in the access of oxygen to ZrC/W, Ni alloy, or Fe alloy surfaces with the use of an inert Cu layer in a 50 ppm $CO/CO_2$ mixture at 750° C.

Embodiments of this invention include the placement of a layer on the surface of an oxidizable material exposed to a buffered supercritical fluid, wherein the composition of the buffered supercritical fluid is chosen to either avoid the oxidation of the layer on the surface of the oxidizable material at a high temperature and pressure above 1 atmosphere and/or the composition of the buffered supercritical fluid is chosen to reduce the rate of oxidation of the oxidizable material located under the surface layer at a high temperature and pressure above 1 atmosphere.

Embodiments of this invention also include the placement of a metal layer (wherein the metal layer includes, but is not limited to, a nickel layer or a copper layer or a cobalt layer) or a metallic alloy layer (wherein the metallic alloy layer includes, but is not limited to, a nickel alloy layer or a copper alloy layer or an iron alloy layer or a cobalt alloy layer) or a ceramic layer (wherein the ceramic layer includes, but is not limited to, an oxide layer or a nitride layer or a carbide layer or a boride layer) or a ceramic composite layer (wherein the ceramic composite layer includes, but is not limited to, a ceramic/ceramic composite layer or a ceramic/metal composite layer) or a combination of two or more of a metal layer, a metallic alloy layer, a ceramic layer, and a ceramic composite layer on an oxidizable material (including, but not limited to, an oxidizable metal or an oxidizable metal alloy or an oxidizable ceramic or an oxidizable ceramic composite) exposed to a buffered supercritical fluid, wherein the composition of the buffered supercritical fluid is chosen to either avoid the oxidation of the metal layer or the metallic alloy layer or the ceramic layer or the ceramic composite layer or the combination of two or more of a metal layer, a metallic alloy layer, a ceramic layer, and a ceramic composite layer at a high temperature and pressure above 1 atmosphere and/or the composition of the buffered supercritical fluid is chosen to reduce the rate of oxidation of the oxidizable material located under the metal layer or the metallic alloy layer or the ceramic layer or the ceramic composite layer or a combination of two or more of a metal layer, a metallic alloy layer, a ceramic layer, and a ceramic composite layer at a high temperature and pressure above 1 atmosphere.

Based on the above detailed description, it is an objective of this disclosure to describe a method of enhancing the corrosion resistance of an oxidizable material exposed to a supercritical fluid. The method includes placing a surface layer on an oxidizable material, and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

It is another objective of this disclosure to describe a corrosion-resistant component prepared by a method which includes placing a surface layer on an oxidizable material; and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

It is another objective of this disclosure to describe a high temperature system comprising a corrosion-resistant component prepared by a method which includes comprising: placing a surface layer on an oxidizable material; and choosing a buffered supercritical fluid containing a reducing agent with the composition of the buffered supercritical fluid containing the reducing agent chosen to avoid the corrosion of the surface layer or reduce the rate of corrosion of the surface layer and avoid the corrosion of the oxidizable material or reduce the rate of corrosion of the oxidizable material at a temperature above the supercritical temperature and supercritical pressure of the supercritical fluid.

It is another objective of this disclosure to describe a method of enhancing the corrosion resistance of an oxidizable material exposed to a supercritical fluid. The method includes choosing a buffered supercritical fluid containing a reducing agent with the composition of the buffered supercritical fluid containing the reducing agent chosen to avoid the corrosion of the oxidizable material or reduce the rate of corrosion of the oxidizable material at a temperature above the supercritical temperature and supercritical pressure of the supercritical fluid.

It is another objective of this disclosure to describe a corrosion-resistant component prepared by a method which includes choosing a buffered supercritical fluid containing a reducing agent with the composition of the buffered supercritical fluid containing the reducing agent chosen to avoid the corrosion of the oxidizable material or reduce the rate of corrosion of the oxidizable material at a temperature above the supercritical temperature and supercritical pressure of the supercritical fluid.

It is another objective of this disclosure to describe a high temperature system comprising a corrosion-resistant component prepared by a method comprising choosing a buffered supercritical fluid containing a reducing agent with the composition of the buffered supercritical fluid containing the reducing agent chosen to avoid the corrosion of the oxidizable material or reduce the rate of corrosion of the oxidizable material at a temperature above the supercritical temperature and supercritical pressure of the supercritical fluid.

It should be recognized that in all of the methods and systems described above, the buffered supercritical mixture can contain CO and $CO_2$. It is to be further recognized that in all of the methods described above, the buffered supercritical mixture can contain $H_2$ and $H_2O$.

Further, in all of the methods and systems described above, the oxidizable material can be a metal, a metal alloy, a ceramic, a ceramic alloy, a metal composite, a ceramic composite material, or any combination thereof. Non-limiting examples of oxidizable metals and metal alloys to which the methods of this disclosure are applicable include but are not limited to nickel, iron, cobalt, and chromium, and alloys thereof. Non-limiting examples of oxidizable ceramics and ceramic alloys to which the methods of this disclosure are applicable include but are not limited to carbides, borides, nitrides, sulfides, halides, and alloys thereof. Further, non-limiting examples of oxidizable metal composite materials to which the methods of this disclosure are applicable include but are not limited to metal-metal composites (including composites with multiple different metal phases) and metal-ceramic composites (including composites with multiple different ceramic and metal phases). Further, non-limiting examples of oxidizable ceramic composite materials to which the methods of this disclosure are applicable include but are not limited to ceramic-metal composites (including composites with multiple different ceramic and metal phases) and ceramic-ceramic composites (including composites with multiple different ceramic phases).

In the some embodiments of the methods of this disclosure described above, the surface layer can be a metal, a metal alloy, a ceramic, a ceramic alloy, a metal composite, a ceramic composite, or any combination thereof. Non-limiting examples of a metal for use as surface layer in the methods of this disclosure include but are not limited to copper, nickel, iron, cobalt. Non-limiting examples of an alloy for use as a surface layer in the methods of this disclosure include but are not limited to alloys of copper, nickel, iron, and cobalt. Non-limiting examples of ceramic for use as a surface layer in the methods of this disclosure include but are not limited to oxides, nitrides, sulfides, halides, carbides or borides. Non-limiting examples of metal composites for use as a surface layer in the methods of this disclosure include but are not limited to metal-metal composites (including composites with multiple different metal phases) and ceramic-metal composites (including composites with multiple different ceramic and metal phases). Non-limiting examples of a ceramic alloy for use as a surface layer in the methods of this disclosure include but are not limited to alloys of oxides, nitrides, sulfides, halides, carbides, borides or combinations thereof. Non-limiting examples of ceramic composites for use as a surface layer in the methods of this disclosure include but are not limited to ceramic-ceramic composites (including composites with multiple different ceramic phases) and ceramic-metal composites (including composites with multiple different ceramic and metal phases).

It should be recognized that, based on the above description, in some embodiments of the methods described above, the oxidizable material comprises zirconium and tungsten and the surface layer contains copper.

It is another objective of this disclosure to describe components utilizing any of the methods described above.

It is another objective of this disclosure to describe systems utilizing components utilizing any of the methods described above.

Several non-limiting examples of materials and systems are described below and are considered to be part of this disclosure giving rise to serval embodiments of the methods and systems of this disclosure. in In the methods, systems and corrosion-resistant components described above the oxidizable material comprises one of a metal, a metal alloy, a ceramic, a ceramic alloy, a metal composite, a ceramic composite and any combination thereof. Further, in all the methods and systems of this disclosure, the metal can be any one of chromium, cobalt, copper, hafnium, iron, manganese, molybdenum, nickel, niobium, silicon, tantalum, titanium, tungsten, vanadium, yttrium, or zirconium. When the methods and systems of this disclosure refer to an alloy, the alloy can comprise two or more of chromium, cobalt, copper, hafnium, iron, manganese, molybdenum, nickel, niobium, silicon, tantalum, titanium, tungsten, vanadium, yttrium, or zirconium or any combination thereof. Further the metal alloy can be one of an iron-based alloy, a nickel-based alloy, or a cobalt-based alloy. When the word "metal composite" is used in the methods and systems of this disclosure, the metal composite comprises one or more of chromium, cobalt, copper, hafnium, iron, manganese, molybdenum, nickel, niobium, silicon, tantalum, titanium, tungsten, vanadium, yttrium, zirconium, and any combination thereof. When the word "ceramic" is used in any of the methods and systems of this disclosure, the ceramic can be a compound comprising is one of a carbide, a boride, an oxide, a sulfide, a nitride, and a halide. When the phrase "ceramic alloy" is used in the methods and systems of this disclosure, the ceramic alloy can be one of a compound, a solid solution, and mixture of one or more of a carbide, a boride, an oxide, a sulfide, a nitride, a halide, and any combination thereof.

Further, in some embodiments of any of the methods, systems and corrosion-resistant components of this disclosure, the ceramic alloy can comprises one or more of the carbides of aluminum, boron, chromium, hafnium, manganese, molybdenum, niobium, scandium, silicon, tantalum, titanium, tungsten, vanadium, ytterbium, yttrium, and zirconium; the borides of cobalt, chromium, hafnium, iron, lanthanum, magnesium, manganese, molybdenum, niobium, neodymium, nickel, rhenium, rhodium, silicon, tantalum, titanium, vanadium, tungsten, yttrium, ytterbium, and zirconium; the nitrides of aluminum, boron, cerium, chromium, iron, hafnium, magnesium, manganese, molybdenum, niobium, nickel, silicon, tantalum, tin, titanium, vanadium, tungsten, yttrium, zinc, and zirconium; and the sulfides of aluminum, barium, bismuth, boron, cadmium, cerium, cesium, chromium, cobalt, copper, indium, iron, lanthanum, manganese, molybdenum, niobium, nickel, scandium, titanium, vanadium, tungsten, zinc, and zirconium.

In some embodiments of any of the methods, systems and corrosion-resistant components of this disclosure the ceramic composite can be is one of a compound, a solid solution, and a mixture of one or more of a carbide, a boride, an oxide, a sulfide, a nitride, a halide, and or any combination thereof. Further the ceramic composite can comprise one or more of the carbides of aluminum, boron, chromium, hafnium, manganese, molybdenum, niobium, scandium, silicon, tantalum, titanium, tungsten, vanadium, ytterbium, yttrium, and zirconium; the borides of cobalt, chromium, hafnium, iron, lanthanum, magnesium, manganese, molybdenum, niobium, neodymium, nickel, rhenium, rhodium, silicon, tantalum, titanium, vanadium, tungsten, yttrium, ytterbium, and zirconium; the nitrides of aluminum, boron, cerium, chromium, iron,hafnium, magnesium, manganese, molybdenum, niobium, nickel, silicon, tantalum, tin, titanium, vanadium, tungsten, yttrium, zinc, and zirconium; and the sulfides of aluminum, barium, bismuth, boron, cadmium, cerium, cesium, chromium, cobalt, copper, indium, iron, lanthanum, manganese, molybdenum, niobium, nickel, scandium, titanium, vanadium, tungsten, zinc, and zirconium. Further the ceramic composite is comprises a ceramic and a metal.

In some embodiments of any of the methods, systems and corrosion-resistant components of this disclosure, the surface layer comprises one of a metal, a metal alloy, a ceramic, a ceramic alloy, a metal composite, a ceramic composite and any combination thereof. Non-limiting examples of metals for this purpose include chromium, cobalt, copper, hafnium, iron, manganese, molybdenum, nickel, niobium, silicon, tantalum, titanium, tungsten, vanadium, yttrium, and zirconium. Further the metal alloy of the surface layer can comprise two or more of chromium, cobalt, copper, hafnium, iron, manganese, molybdenum, nickel, niobium, silicon, tantalum, titanium, tungsten, vanadium, yttrium, zirconium and any combination thereof. Further the metal composite in any of the methods and systems of this disclosure can comprise one or more of chromium, cobalt, copper, hafnium, iron, manganese, molybdenum, nickel, niobium, silicon, tantalum, titanium, tungsten, vanadium, yttrium, zirconium and any combination thereof.

In some embodiments of the methods, systems and corrosion-resistant components of this disclosure, the surface layer comprises one of copper, a copper alloy, a copper composite, and any combination thereof; one of nickel, a nickel alloy, a nickel composite, and any combination thereof; or one of cobalt, a cobalt alloy, a cobalt composite, and any combination thereof.

In some embodiments of the methods, systems and corrosion-resistant components of this disclosure, the oxidizable material comprises zirconium and tungsten and the surface layer comprises one of copper, copper alloy and a copper composite. In some embodiments of the methods and systems of this disclosure, wherein the oxidizable material comprises a nickel-based alloy and the surface layer comprises one of copper, a copper alloy and a copper composite. In some embodiments, the oxidizable material comprises an iron-based alloy and the surface layer comprises one of copper, a copper alloy and a copper composite. In some embodiments, the oxidizable material comprises a cobalt-based alloy and the surface layer comprises one of copper, a copper alloy and a copper composite.

In some embodiments of the high temperature systems of this disclosure, the system is one of an electrical power production system, a waste-heat recovery system, a transportation system, and a propulsion system. In some embodiments, the electrical power production system is one of a a system for fossil fuel-derived power, a system for solar energy-derived power, a system for nuclear energy-derived power, and system for thermionics. Ins some embodiments, the solar energy-derived power system is a concentrating solar power system. In some embodiments of the to high temperature systems the component is chosen from the group consisting of piping, valves, heat exchangers, pump components, bearings, heat sinks, energy conversion devices, and engine components. In some embodiments the engine components are chosen from the group consisting of turbine blades, pistons, and compressors.

While the present disclosure has been described with reference to certain embodiments, it will be apparent to those of ordinary skill in the art that other embodiments and implementations are possible that are within the scope of the present disclosure without departing from the spirit and scope of the present disclosure. Thus, the implementations should not be limited to the particular limitations described. Other implementations may be possible. It is therefore intended that the foregoing detailed description be regarded as illustrative rather than limiting. Thus, this disclosure is limited only by the following claims.

The invention claimed is:

1. A method of enhancing the corrosion resistance of an oxidizable material to an oxidizing fluid that is corrosive to the oxidizable material, the method comprising:

forming a buffered mixture of carbon dioxide as the oxidizing fluid and carbon monoxide as a reducing species that reduces the thermodynamic driving for reaction of the oxidizing fluid with the oxidizable material, the buffered mixture containing a ratio of the carbon monoxide fugacity to the carbon dioxide fugacity of at least 0.0000153;

depositing a surface layer containing copper on a surface of the oxidizable material; and with the buffered mixture at a temperature of at least 750° C. and a pressure at or above 7.4 MPa to result in the buffered mixture being a buffered supercritical fluid, contacting the surface layer with the buffered supercritical fluid, the carbon monoxide of the reducing species rendering the copper of the surface layer inert to the buffered supercritical fluid and reducing the thermodynamic driving force for oxidative corrosion of the oxidizable material by the carbon dioxide of the oxidizing fluid.

2. The method of claim 1, wherein the buffered supercritical fluid contains a ratio of the carbon monoxide fugacity to the carbon dioxide fugacity of 0.000040 to 0.000060.

3. The method of claim 1, wherein the oxidizable material comprises one of a metal, a metal alloy, a ceramic, a ceramic alloy, a metal composite, a ceramic composite or any combination thereof.

4. The method of claim 1, wherein the oxidizable material further comprises at least one metal chosen from the group consisting of chromium, cobalt, hafnium, iron, manganese, molybdenum, nickel, niobium, silicon, tantalum, titanium, tungsten, vanadium, yttrium, and zirconium.

5. A method of using a corrosion-resistant component having an oxidizable material and exposing the corrosion-resistant component to an oxidizing fluid that is corrosive to the oxidizable material, the method comprising:

forming a buffered mixture of carbon dioxide as the oxidizing fluid and carbon monoxide as a reducing species that reduces the thermodynamic driving for reaction of the oxidizing fluid with the oxidizable material, the buffered mixture containing a ratio of the carbon monoxide fugacity to the carbon dioxide fugacity of at least 0.0000153;

depositing a surface layer containing copper on a surface of the oxidizable material; and with the buffered mixture at a temperature of at least 750° C. and a pressure at or above 7.4 MPa to result in the buffered mixture being a buffered supercritical fluid, contacting the surface layer with the buffered supercritical fluid, the carbon monoxide of the reducing species rendering the copper of the surface layer inert to the buffered supercritical fluid and reducing the thermodynamic driving force for oxidative corrosion of the oxidizable material by the carbon dioxide of the oxidizing fluid.

6. The method of claim 5, wherein the buffered supercritical fluid contains a ratio of the carbon monoxide fugacity to the carbon dioxide fugacity of 0.000040 to 0.000060.

7. The method of claim 5, wherein the oxidizable material comprises one of a metal, a metal alloy, a ceramic, a ceramic alloy, a metal composite, a ceramic composite or any combination thereof.

8. The method of claim 5, wherein the oxidizable material further comprises at least one metal chosen from the group consisting of chromium, cobalt, hafnium, iron, manganese, molybdenum, nickel, niobium, silicon, tantalum, titanium, tungsten, vanadium, yttrium, and zirconium.

9. The method of claim 5, wherein the component is chosen from the group consisting of piping, valves, heat exchangers, pump components, bearings, heat sinks, energy conversion devices, and engine components.

10. The method of claim 5, wherein the corrosion-resistant component is a component of a high temperature system.

11. The method of claim 10, wherein the system is one of an electrical power production system, a waste heat recovery system, a transportation system, and a propulsion system.

12. The method of claim 10, wherein the oxidizable material is one of a metal, a metal alloy, a metal composite, or any combination thereof, and the oxidizable material further comprises at least one metal chosen from the group consisting of chromium, cobalt, hafnium, iron, manganese, molybdenum, nickel, niobium, silicon, tantalum, titanium, tungsten, vanadium, yttrium, and zirconium.

13. The method of claim 12, wherein the surface layer has a thickness between one hundred microns and 1 millimeter.

14. The method of claim 10, wherein the surface layer consists of copper.

15. The method of claim 10, wherein the surface layer coats a passageway in a power system.

16. The method of claim 10, wherein the surface layer coats a passageway in a heat exchanger.

17. A method of operating a power system with a passageway formed by an oxidizable material with a surface layer that contains a copper material, the method comprising:

heating a working fluid of the power system to a temperature of at least 750° C. and a pressure at or above 7.4 MPa to result in the working fluid being a buffered supercritical fluid of carbon dioxide as an oxidizing fluid and carbon monoxide as a reducing species at a ratio of at least 0.0000153 of the carbon monoxide fugacity to the carbon dioxide fugacity; and rendering the copper material of the surface layer inert to the buffered supercritical fluid by passing the buffered supercritical fluid through the passageway so that the carbon monoxide therein renders the copper material inert to the carbon dioxide therein.

18. The method of claim 17, wherein the surface layer has a thickness between one hundred microns and 1 millimeter.

19. The method of claim 17, further comprising maintaining a carbon monoxide content in the buffered supercritical fluid at a ratio of the carbon monoxide fugacity to the carbon dioxide fugacity of 0.000040 to 0.000060.

20. The method of claim 17, wherein the oxidizable material is one of a metal, a metal alloy, a metal composite, or any combination thereof, and the oxidizable material further comprises at least one metal chosen from the group consisting of chromium, cobalt, hafnium, iron, manganese, molybdenum, nickel, niobium, silicon, tantalum, titanium, tungsten, vanadium, yttrium, and zirconium.

21. A method of rendering inert a surface layer on an oxidizable material in a heat exchanger or a power system, the method comprising:

forming a buffered mixture of carbon dioxide as an oxidizing fluid and carbon monoxide as a reducing species that reduces the thermodynamic driving for reaction of the oxidizing fluid with the oxidizable material, the buffered mixture containing a ratio of the carbon monoxide fugacity to the carbon dioxide fugacity of at least 0.0000153;

depositing the surface layer containing copper on a surface of the oxidizable material; and with the buffered mixture at a temperature of at least 750° C. and a pressure at or above 7.4 MPa to result in the buffered mixture being a buffered supercritical fluid, contacting the surface layer with the buffered supercritical fluid, the carbon monoxide of the reducing species rendering the copper of the surface layer inert to the buffered supercritical fluid and reducing the thermodynamic driving force for oxidative corrosion of the oxidizable material by the carbon dioxide of the oxidizing fluid.

22. The method of claim 21, wherein the surface layer coats a passageway in the heat exchanger or power system.

23. The method of claim 21, wherein the surface layer consists of copper.

24. The method of claim 21, wherein the oxidizable material is one of a metal, a metal alloy, a metal composite, or any combination thereof, and the oxidizable material further comprises at least one metal chosen from the group consisting of chromium, cobalt, hafnium, iron, manganese, molybdenum, nickel, niobium, silicon, tantalum, titanium, tungsten, vanadium, yttrium, and zirconium.

* * * * *